US011772926B2

(12) United States Patent
Yamano et al.

(10) Patent No.: US 11,772,926 B2
(45) Date of Patent: Oct. 3, 2023

(54) SHEET DISCHARGING APPARATUS, SHEET PROCESSING APPARATUS, AND IMAGE FORMING SYSTEM

(71) Applicant: CANON KABUSHIKI KAISHA, Tokyo (JP)

(72) Inventors: Hiroyuki Yamano, Kanagawa (JP); Shinya Noda, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/591,885

(22) Filed: Feb. 3, 2022

(65) Prior Publication Data

US 2022/0267115 A1 Aug. 25, 2022

(30) Foreign Application Priority Data

Feb. 22, 2021 (JP) ..... 2021-026311

(51) Int. Cl.

| | |
|---|---|
| ***B65H 29/00*** | (2006.01) |
| ***B65H 37/04*** | (2006.01) |
| ***B65H 29/52*** | (2006.01) |
| ***B65H 31/30*** | (2006.01) |
| ***B65H 29/60*** | (2006.01) |
| ***B65H 29/12*** | (2006.01) |

(52) U.S. Cl.

CPC ..... *B65H 37/04* (2013.01); *B65H 29/125* (2013.01); *B65H 29/52* (2013.01); *B65H 29/60* (2013.01); *B65H 31/3027* (2013.01); *B65H 2301/5161* (2013.01)

(58) Field of Classification Search

CPC ..... B65H 37/04; B65H 31/3027; B65H 31/3009; B65H 31/3018; B65H 29/125; B65H 29/34; B65H 29/26; B65H 29/38

USPC ..... 270/58.11

See application file for complete search history.

(56) References Cited

U.S. PATENT DOCUMENTS 6,264,191 B1 * 7/2001 Suzuki ..... B65H 29/34 271/189
6,264,194 B1 * 7/2001 Hayashi ..... B65H 31/3027 271/220

(Continued)

FOREIGN PATENT DOCUMENTS

JP 2000326588 A 11/2000
JP 2007269488 A 10/2007

(Continued)

*Primary Examiner* — Leslie A Nicholson, III

(74) *Attorney, Agent, or Firm* — ROSSI, KIMMS & McDOWELL LLP

(57) ABSTRACT

A sheet discharging apparatus includes a guide member configured to guide a lower surface of a sheet, a discharge roller pair, a stacking portion, and a first moving member and a second moving member each configured to move to a first position and a second position, the first position being a position where the first moving member and the second moving member protrude downstream of the discharge roller pair in the sheet discharge direction, the second position being a position located upstream of the first position in the sheet discharge direction. Support portions of the first moving member and the second moving member in the first position protrude upward in a height direction with respect to a tangent of a lower roller of the discharge roller pair when viewed in a sheet width direction.

17 Claims, 15 Drawing Sheets

(56) References Cited

U.S. PATENT DOCUMENTS

| | | | | |
|---|---|---|---|---|
| 6,742,949 | B2 * | 6/2004 | Youn | B41J 13/106 271/213 |
| 6,997,456 | B2 * | 2/2006 | Fukatsu | G03G 15/6538 271/189 |
| 7,341,248 | B2 * | 3/2008 | Kuwata | B65H 31/3018 399/407 |
| 7,690,636 | B2 * | 4/2010 | Noh | G03G 15/6573 270/58.11 |
| 7,874,558 | B2 * | 1/2011 | Ogata | B65H 31/3018 271/189 |
| 9,988,231 | B2 | 6/2018 | Nakano | |
| 10,351,383 | B2 * | 7/2019 | Saito | B65H 31/36 |
| 10,737,897 | B2 * | 8/2020 | Kondo | B65H 31/3018 |
| 10,773,918 | B2 * | 9/2020 | Hatakeyama | B65H 31/3018 |
| 11,084,679 | B2 * | 8/2021 | Tsuchiya | B65H 31/38 |
| 11,142,423 | B2 | 10/2021 | Kotani | |
| 2021/0024316 | A1 | 1/2021 | Kotani | |

FOREIGN PATENT DOCUMENTS

| | | | |
|---|---|---|---|
| JP | 2016173500 | A | 9/2016 |
| JP | 2017043476 | A | 3/2017 |
| JP | 2017052616 | A | 3/2017 |
| JP | 2020179943 | A | 11/2020 |
| JP | 2021020769 | A | 2/2021 |

* cited by examiner

SHEET DISCHARGING APPARATUS, SHEET PROCESSING APPARATUS, AND IMAGE FORMING SYSTEM

BACKGROUND OF THE INVENTION

Field of the Invention

This invention relates to a sheet discharging apparatus that discharges a sheet, a sheet processing apparatus that processes the sheet, and an image forming system that forms an image on the sheet.

Description of the Related Art

In an image forming system, a sheet on which an image has been formed and which has been treated with processes such as a binding process is discharged outside the apparatus by a sheet discharging unit, and stacked on a stacking portion such as a stacking tray. As the sheet discharging unit, for example, a roller pair that nips and conveys the sheet is used. Further, the sheet discharging unit includes a unit that discharges the sheet one by one at a time, and a unit that discharges a sheet bundle constituted by a plurality of sheets of the sheet.

If a newly discharged sheet discharged by the sheet discharging unit rubs an upper surface of a sheet already stacked on the stacking portion (hereinafter referred to as a stacked sheet), there is a possibility that a position of the stacked sheet becomes disordered due to friction force and the alignment of the sheet is degraded. Japanese Patent Laid-Open Nos. 2007-269488 and 2017-043476 disclose that the degradation of the alignment of the sheet is suppressed by supporting a lower surface of a sheet in the middle of discharge above the stacking tray by a guide member movable in a manner of protruding to a downstream side of a discharge roller pair.

However, even in a case where the configuration described in the above documents is used, in some cases, a leading edge of the sheet in the middle of the discharge hangs down by the force of gravity, and rubs the upper surface of the stacked sheet, so that the degradation of the alignment of the sheet may occurs.

SUMMARY OF THE INVENTION

The present invention provides a sheet discharging apparatus, a sheet processing apparatus, and an image forming system that can suppress degradation in sheet alignment.

According to one aspect of the invention, a sheet discharging apparatus includes a guide member configured to guide a lower surface of a sheet that is discharged, a discharge roller pair including an upper roller configured to be in contact with an upper surface of the sheet and a lower roller configured to be in contact with the lower surface of the sheet, the discharge roller pair being configured to discharge the sheet in a sheet discharge direction by nipping the sheet with the upper roller and the lower roller, a stacking portion on which the sheet discharged by the discharge roller pair is stacked, and a first moving member and a second moving member each configured to move to a first position and a second position, the first position being a position where the first moving member and the second moving member protrude downstream of the discharge roller pair in the sheet discharge direction, the second position being a position located upstream of the first position in the sheet discharge direction, the first moving member and the second moving member being disposed separately from each other in a sheet width direction perpendicular to the sheet discharge direction, wherein each of the first moving member and the second moving member includes a support portion configured to support the lower surface of the sheet sent from the discharge roller pair, and wherein the support portions of the first moving member and the second moving member in the first position protrude upward in a height direction with respect to a tangent of the lower roller when viewed in the sheet width direction, the height direction being a direction orthogonally intersecting with both of the sheet discharge direction and the sheet width direction, the tangent of the lower roller being a straight line that is parallel to the guide member, is tangent to an outer peripheral surface of the lower roller, and passes above a rotational axis of the lower roller.

According to another aspect of the invention, a sheet discharging apparatus includes a guide member configured to guide a lower surface of a sheet that is discharged, a discharger configured to discharge the sheet in a sheet discharge direction, a stacking portion on which the sheet discharged by the discharger is stacked, and a first moving member and a second moving member each configured to move to a first position and a second position, the first position being a position where the first moving member and the second moving member protrude downstream of the discharger in the sheet discharge direction, the second position being a position located upstream of the first position in the sheet discharge direction, the first moving member and the second moving member being disposed separately from each other in a sheet width direction perpendicular to the sheet discharge direction, wherein, each of the first moving member and the second moving member includes a support portion configured to support the lower surface of the sheet sent from the discharger in a state where the first moving member and the second moving member are located in the first position, and wherein the support portions of the first moving member and the second moving member in the first position protrude upward in a height direction with respect to an extended line of the guide member when viewed in the sheet width direction, the height direction being a direction orthogonally intersecting with both of the sheet discharge direction and the sheet width direction.

According to still another aspect of the invention, a sheet discharging apparatus includes a discharger configured to discharge a sheet in a sheet discharge direction, a stacking portion on which the sheet discharged by the discharger is stacked, and a first moving member, a second moving member, and a third moving member each configured to move to a first position and a second position, the first position being a position where the first moving member, the second moving member, and the third moving member protrude downstream in the sheet discharge direction from the discharger, the second position being a position located upstream of the first position in the sheet discharge direction, wherein the third moving member is disposed between the first moving member and the second moving member in a sheet width direction perpendicular to the sheet discharge direction, wherein each of the first moving member, the second moving member, and the third moving member includes a support portion configured to support the lower surface of the sheet sent from the discharger in a state where the first moving member, the second moving member, and the third moving member are located in the first position, and wherein, in a state where the first moving member, the second moving member, and the third moving member are located in the first position, both of the support portions of first moving member and the second moving member protrude upward in a height direction with respect to the support portion of the third moving member, the height direction being a direction orthogonally intersecting with both of the sheet discharge direction and the sheet width direction.

Further features of the present invention will become apparent from the following description of exemplary embodiments with reference to the attached drawings.

DESCRIPTION OF THE EMBODIMENTS

Hereinafter, embodiments of this disclosure will be described with reference to drawings.

First Embodiment

Figure 1:
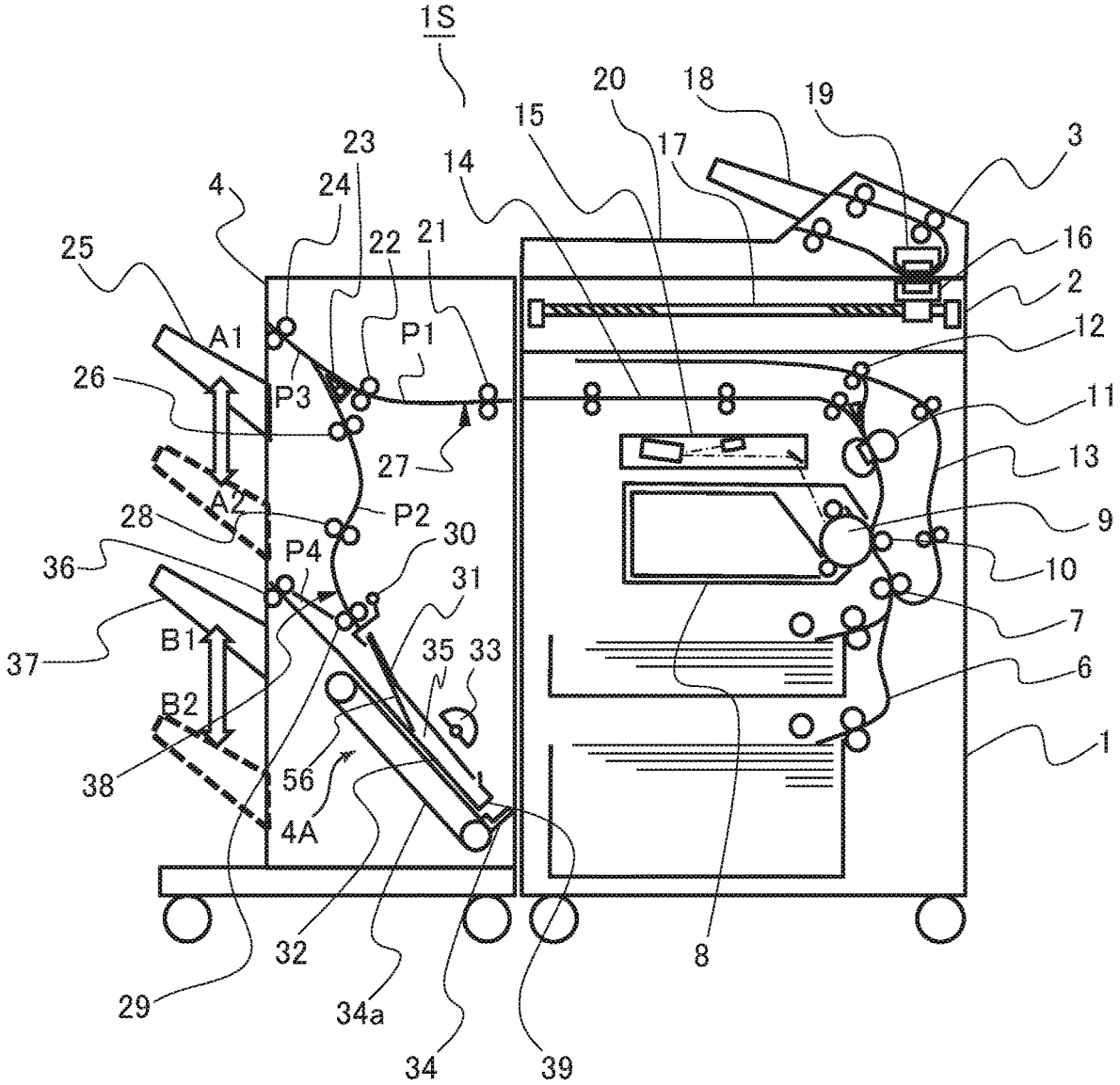
FIG. 1 is a schematic view showing an image forming system according to a first embodiment.

FIG. 1 is a schematic view of an image forming system 1S according to a first embodiment. The image forming system 1*s* of this embodiment includes an image forming apparatus 1, an image reading apparatus 2, a document feeding apparatus 3, and a post-processing apparatus 4. The image forming system 1S forms an image on a sheet, serving as a recording material, and outputs the sheet after treating the sheet with processes by the post-processing apparatus 4 when necessary. Hereinafter, the operation of each apparatus will be described briefly, and then the post-processing apparatus 4 will be described in detail.

The document feeding apparatus 3 conveys a document placed on a document tray 18 to image reading units 16 and 19. The image reading units 16 and 19 each are image sensors that read image information from document surfaces, and both surfaces of the document are read in one time of the conveyance of the document. The document whose image information has been read is discharged onto a document discharge portion 20. Further, the image reading apparatus 2 is capable of reading image information from a still document (including a document such as a booklet document for which the document feeding apparatus 3 is not usable) that is set on a platen glass, by reciprocating the image reading unit 16 by a driving device 17.

The image forming apparatus 1 is an electrophotographic apparatus including an image forming unit 1B of a direct transfer system. The image forming unit 1B includes a cartridge 8 including a photosensitive drum 9, and a laser scanner unit 15 disposed above the cartridge 8. In a case of performing an image forming operation, a surface of the photosensitive drum 9 that rotates is charged, and the laser scanner unit 15 draws an electrostatic latent image on the surface of the photosensitive drum 9 by exposing the photosensitive drum 9 based on the image information. The electrostatic latent image borne on the photosensitive drum 9 is developed into a toner image by charged toner particles, and the toner image is transferred to a transfer portion where the photosensitive drum 9 and a transfer roller 10 face each other. The controller of the image forming apparatus 1 causes the image forming unit 1B to execute the image forming operation based on the image information read by the image reading units 16 and 19 or the image information received from an external computer via a network.

The image forming apparatus 1 includes a plurality of feeding apparatuses 6 that feed the sheet one by one at a predetermined interval. It is possible to use various kinds of sheet materials different in a size and a material as the sheet, serving as the recording material, including a paper such as a standard paper and cardboard, a plastic film, a cloth, a surface treated sheet such as a coated paper, and a sheet material having a special shape such as an envelope and an index sheet. The sheet fed from the feeding apparatus 6 is conveyed to the transfer portion after the skew is corrected by a registration roller pair 7, and the toner image borne on the photosensitive drum 9 is transferred to the sheet in the transfer portion. A fixing unit 11 is disposed downstream of the transfer portion in a sheet conveyance direction. The fixing unit 11 includes a rotary member pair for nipping and conveying the sheet, and a heat generation member such as a halogen lamp for heating the toner image, and performs a fixing process of the toner image on the sheet by heating and pressing the toner image.

In the case of discharging the sheet with the image formed on the sheet outside the image forming apparatus 1, the sheet passed through the fixing unit 11 is conveyed to the post-processing apparatus 4 via a horizontal conveyance portion 14. In duplex printing, in a case of the sheet with the image formation on the first surface completed, the sheet passed through the fixing unit 11 is delivered to a reverse conveyance roller pair 12, is conveyed in a switchback manner by the reverse conveyance roller pair 12, and is conveyed to the registration roller pair 7 again through a reconveyance portion 13. Then, after the image has been formed on a second surface of the sheet by passing through the transfer portion and the fixing unit 11 again, the sheet is conveyed to the post-processing apparatus 4 through the horizontal conveyance portion 14.

The image forming unit 1B described above is an example of the image forming unit forming the image on the sheet, and it is acceptable to use an electrophotographic unit of an intermediate transfer system that transfers the toner image formed on a photosensitive member onto the sheet through an intermediate transfer member. Further, it is acceptable to use a printing unit of an inkjet system or an offset printing system as the image forming unit.

Post-Processing Apparatus

The post-processing apparatus 4, serving as a sheet processing apparatus of this embodiment, includes a binding process unit 4A serving as a processing unit. The binding process unit performs a binding process on a plurality of sheets of the sheet received from the image forming apparatus 1, and discharges a sheet bundle which has been treated with the binding process. Further, the post-processing apparatus 4 is also capable of simply discharging the sheet received from the image forming apparatus 1 without performing the binding process.

The post-processing apparatus 4 includes a receiving path P1, an internal discharge path P2, a first discharge path P3, and a second discharge path P4 as conveyance paths for conveying the sheet, and includes an upper discharge tray 25 and a lower discharge tray 37 as discharge destinations onto which the sheet is discharged. The receiving path P1 serves as a first conveyance path of this embodiment through which the sheet is received and conveyed from the image forming apparatus 1, and the internal discharge path P2 serves as a second conveyance path of this embodiment through which the sheet is conveyed toward the binding process unit 4A. The internal discharge path P2 branches from the receiving path P1, serving as the first conveyance path, and the first discharge path P3. The internal discharge path P2 extends downward in the inside of the post-processing apparatus 4, and is coupled to the binding process unit 4A. The first discharge path P3 is a conveyance path through which the sheet is discharged onto the upper discharge tray 25, and the second discharge path P4 is a conveyance path (third conveyance path) through which the sheet is discharged onto the lower discharge tray 37.

In the receiving path P1, an inlet roller pair 21, a pre-buffer roller pair 22, and an inlet sensor 27 are disposed. In the first discharge path P3, an inverse roller pair 24 serving as a discharger (first discharger) discharging the sheet to the upper discharge tray 25 and serving as an inversion unit or reverse unit sending the sheet to the internal discharge path P2 by inverting (reversing) and conveying the sheet is disposed. In the internal discharge path P2, an internal discharge roller pair 26, an intermediate conveyance roller pair 28, a kick-out roller pair 29, and a pre-intermediate stacking sensor 38 are disposed. In the second discharge path P4, a bundle discharge roller pair 36 is disposed. Both of the inlet sensor 27 and the pre-intermediate stacking sensor 38 are an example of a sheet detection unit that detects a passage of the sheet in a predetermined detection position in a conveyance path within the sheet processing apparatus. As the inlet sensor 27 and the pre-intermediate stacking sensor 38, it is possible to use an optical sensor, described in another section, that detects the presence/absence of the sheet at the detection position by using light.

A sheet conveyance route in the post-processing apparatus 4 will be described below. A buffer operation by a buffer unit 4B including the inverse roller pair 24, and a detailed configuration and an operation of the binding process unit 4A will be described in another section.

The sheet discharged from the horizontal conveyance portion 14 of the image forming apparatus 1 is received by the inlet roller pair 21, and conveyed toward the pre-buffer roller pair 22 through the receiving path P1. The inlet sensor 27 detects the sheet in a detection position between the inlet roller pair 21 and the pre-buffer roller pair 22. The pre-buffer roller pair 22 conveys the sheet received from the inlet roller pair 21 toward the first discharge path P3.

To be noted, in a predetermined timing after the inlet sensor 27 has detected a passage of a trailing edge of the sheet, the pre-buffer roller pair 22 increases a conveyance speed of the sheet faster than the conveyance speed in the horizontal conveyance portion 14. Further, it is acceptable to set the conveyance speed of the sheet by the inlet roller pair 21 larger than the conveyance speed of the sheet in the horizontal conveyance portion 14 and accelerate the conveyance speed by the inlet roller pair 21 upstream of the pre-buffer roller pair 22. In this case, it is suitable that a one-way clutch is disposed between conveyance roller pairs in the horizontal conveyance portion 14 and a motor driving the conveyance roller pairs so that the conveyance roller pairs can be rotated freely even if the sheet is pulled by the inlet roller pair 21.

In a case where the discharge destination of the sheet is the upper discharge tray 25, the inverse roller pair 24 discharges the sheet received from the pre-buffer roller pair 22 to the upper discharge tray 25. In this case, the inverse roller pair 24 decelerates to a predetermined discharge speed in a predetermined timing after the trailing edge of the sheet has passed through the pre-buffer roller pair 22.

In a case where the discharge destination of the sheet is the lower discharge tray 37, the inverse roller pair 24 inversely conveys (i.e., switchback) the sheet received from the pre-buffer roller pair 22 to the internal discharge path P2. At a branch portion where the receiving path P1 and the internal discharge path P2 branch from the first discharge path P3 on an upstream side of the inverse roller pair 24 in the sheet conveyance direction by the inverse roller pair 24, a non-return guide 23 is disposed. The non-return guide 23 regulates a conveyance direction of the sheet switchbacked by the inverse roller pair 24 so that the sheet would not be conveyed backward to the receiving path P1.

The internal discharge roller pair 26, the intermediate conveyance roller pair 28, and the kick-out roller pair 29 disposed in the internal discharge path P2 convey the sheet received from the inverse roller pair 24 toward an intermediate stacking unit 35 disposed in the binding process unit 4A while receiving and delivering the sheet successively. At this time, the trailing edge of the sheet already stacked in the intermediate stacking unit 35 is pressed by a bundle pressing flag 30 disposed adjacent to the kick-out roller pair 29. Thereby, a leading edge of the sheet newly discharged to the intermediate stacking unit 35 by the kick-out roller pair 29 is prevented from colliding with the trailing edge of the sheet already stacked in the intermediate stacking unit 35. Further, the pre-intermediate stacking sensor 38 detects the sheet between the intermediate conveyance roller pair 28 and the kick-out roller pair 29.

The intermediate stacking unit 35 is constructed by a stacking lower guide 32 supporting a lower surface of the sheet and a stacking upper guide 31 facing an upper surface of the sheet. In the intermediate stacking unit 35, a longitudinal alignment reference plate 39 serving as an alignment reference of the sheet with respect to the sheet conveyance direction is disposed. Further, a pressing guide 56 having an elastic property is fixed to the stacking upper guide 31, and presses the upper surface of the sheet stacked on the intermediate stacking unit 35 with a predetermined pressing force. The sheet discharged to the intermediate stacking unit 35 abuts onto the longitudinal alignment reference plate 39 by a semicircular (or half-moon shaped) roller 33, serving as a first alignment member, on a downstream side of the pressing guide 56, so that a position of the sheet in terms of the sheet conveyance direction is aligned. That is, the semicircular roller 33 rotates in a predetermined timing after the trailing edge of the sheet has passed through the pre-intermediate stacking sensor 38, so that the abutting alignment described above is performed. The contact pressure of the semicircular roller 33 onto the sheet is adjusted so that the semicircular roller 33 can slip with respect to the sheet after the trailing edge of the sheet has abutted onto the longitudinal alignment reference plate 39. Further, subsequent to the alignment by the semicircular roller 33, the sheet is moved in a sheet width direction perpendicular to the sheet conveyance direction by a lateral alignment jogger (not illustrated) serving as an alignment member moving in the sheet width direction. Then, a side edge of the sheet abuts onto a lateral alignment plate (not illustrated), serving as an alignment reference of the sheet in the sheet width direction, so that a position of the sheet in terms of the sheet width direction is aligned.

The binding process unit 4A includes a stapler 51, serving as a binding unit of this embodiment, and binds a predetermined position of the sheet bundle by the stapler 51 after a plurality of sheets of the sheet received from the internal discharge path P2 have been aligned. By a bundle discharge guide 34 driven along the sheet conveyance direction by a belt 34*a*, the sheet bundle bound by the binding process unit 4A is sent to a direction opposite to a discharge direction to the intermediate stacking unit 35 by the kick-out roller pair 29. Then, the sheet bundle delivered to the bundle discharge unit 36 through the second discharge path P4, serving as the third conveyance path, is discharged to the lower discharge tray 37 by the bundle discharge unit 36. A detailed configuration and movement of the bundle discharge unit 36 will be described in another section.

To be noted, the post-processing apparatus 4 of this embodiment is capable of conveying an A4 size (A4 size in ISO 216: short edge 210 mm and long edge 297 mm) sheet in a long edge feed orientation. The long edge feed orientation is a sheet orientation in which the long edge extends parallel to the sheet conveyance direction and the short edge becomes perpendicular to the sheet conveyance direction. Accordingly, the bundle discharge unit 36, is, for example, capable of conveying the sheet bundle of the A4 size treated with the binding process by a long edge feeding and discharging the sheet bundle to the lower discharge tray 37. Further, the binding process unit 4A is capable of performing processes of binding a plurality of portions along one of the long edges (long side binding) and binding a corner of the sheet bundle (corner binding).

Both of the upper discharge tray 25 and the lower discharge tray 37 are movable in upper and lower directions with respect to a casing of the post-processing apparatus 4. The post-processing apparatus 4 includes sheet surface detection sensors for detecting positions of upper surfaces of the sheet (stacking height of the sheet) on the upper discharge tray 25 and the lower discharge tray 37, and, when either one of the sensors detects the sheet, the corresponding tray is lowered in an A2 or B2 direction. Further, when the sheet surface detection sensors have detected that the sheet on the upper discharge tray 25 or the lower discharge tray 37 has been removed, the corresponding tray is lifted in an A1 or B1 direction. Therefore, an ascent and descent of the upper discharge tray 25 and the lower discharge tray 37 are controlled so as to maintain the upper surfaces of the stacked sheets at constant heights.

Bundle Discharge Unit

Next, the bundle discharge unit 36 will be described in detail. The bundle discharge unit 36 constructs a sheet discharging apparatus of this embodiment with the lower discharge tray 37, serving as a stacking portion for stacking the sheet discharged by the bundle discharge unit 36.

Figure 2A:
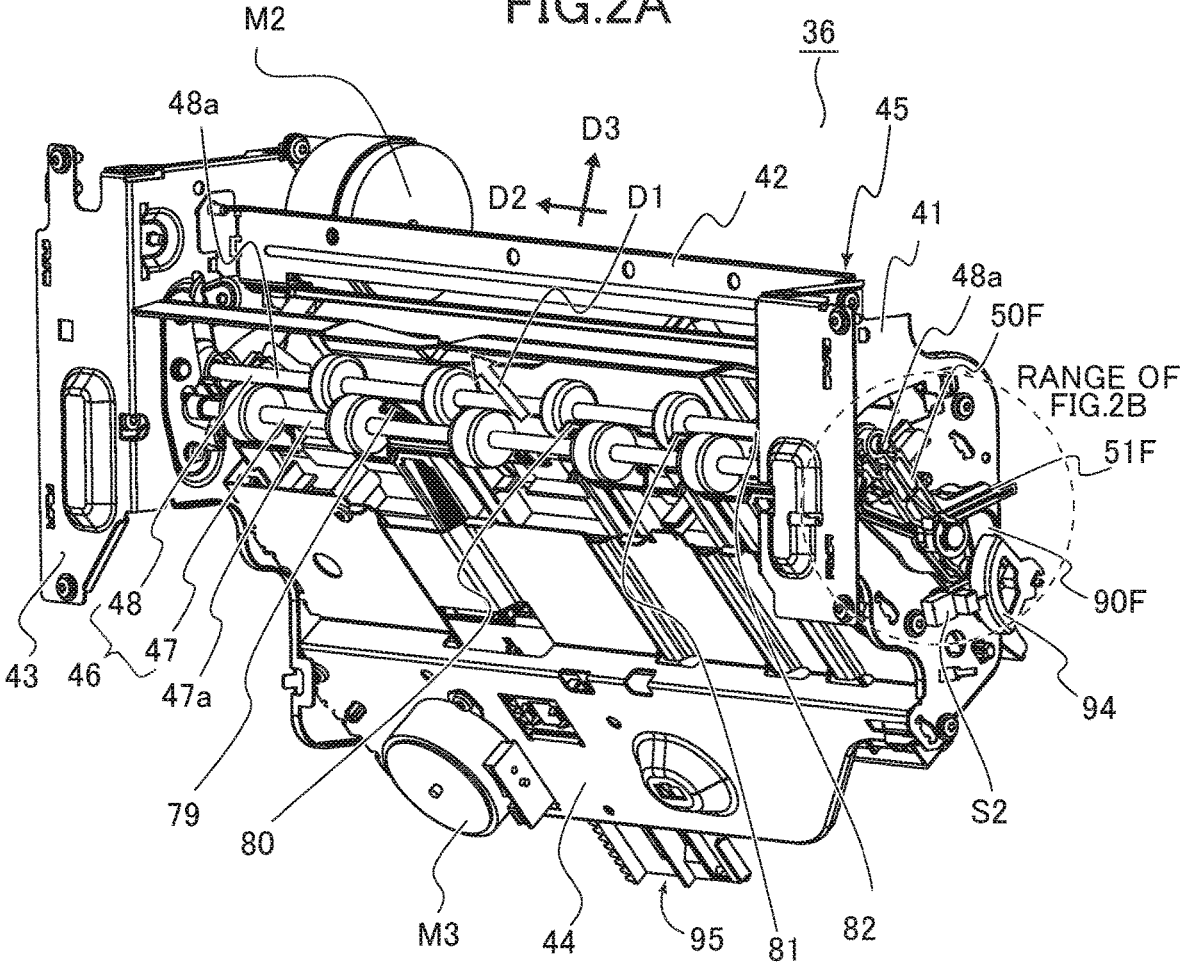
FIG. 2A is a perspective view showing a bundle discharge unit according to the first embodiment.
Figure 2B:
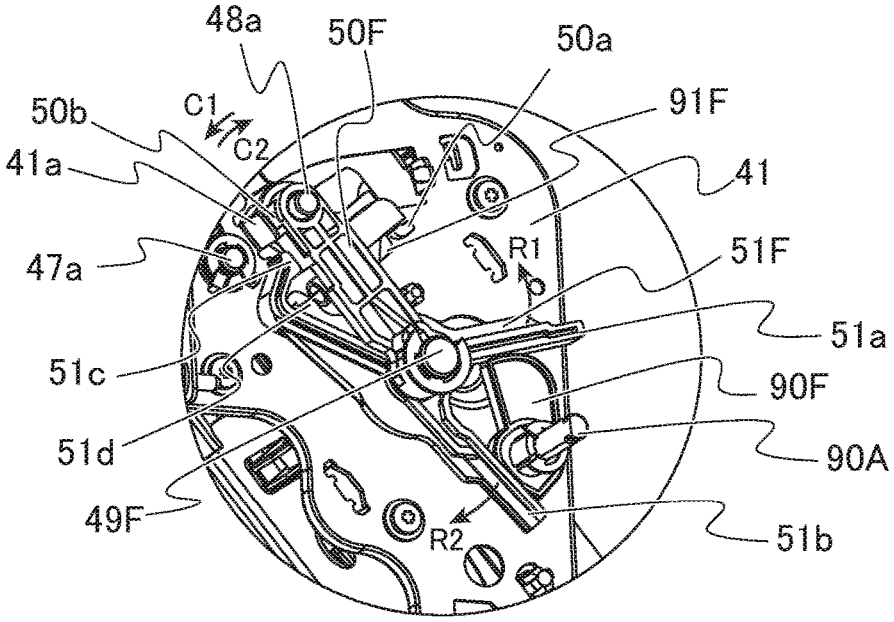
FIG. 2B is an enlarged view enlarging a part of FIG. 2A.
Figure 3A:
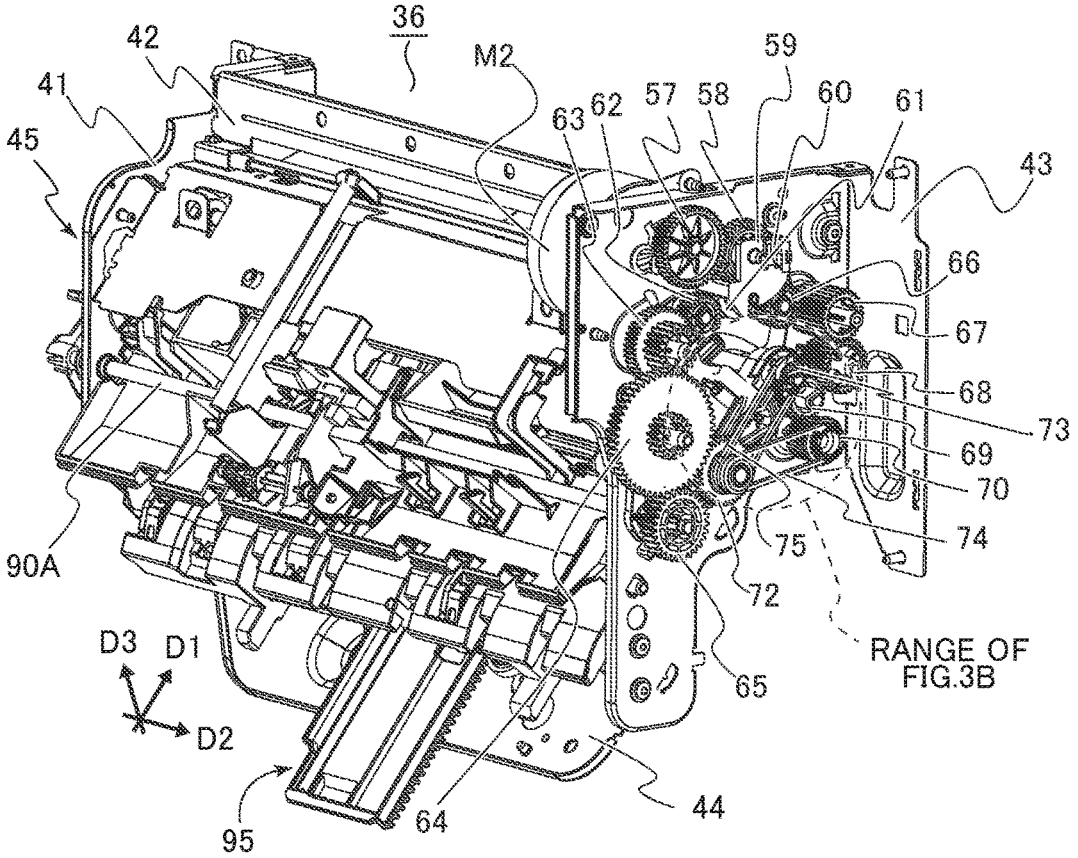
FIG. 3A is a perspective view showing the bundle discharge unit according to the first embodiment.
Figure 3B:
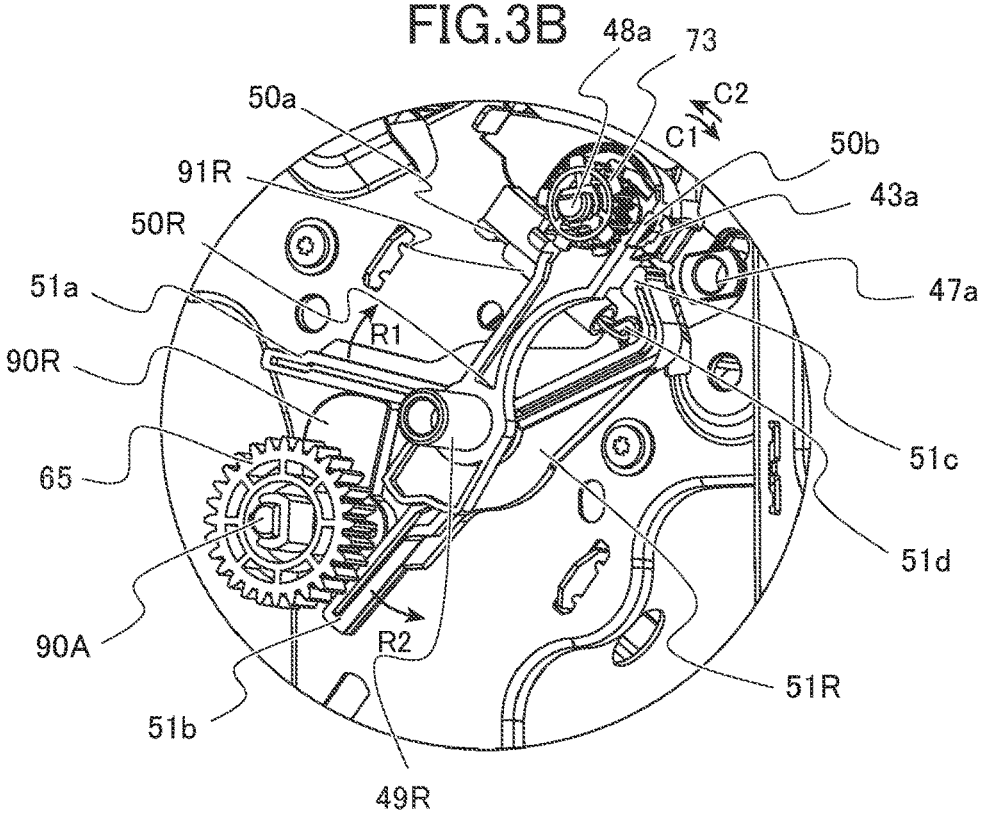
FIG. 3B is an enlarged view enlarging a part of FIG. 3A.
Figure 4:
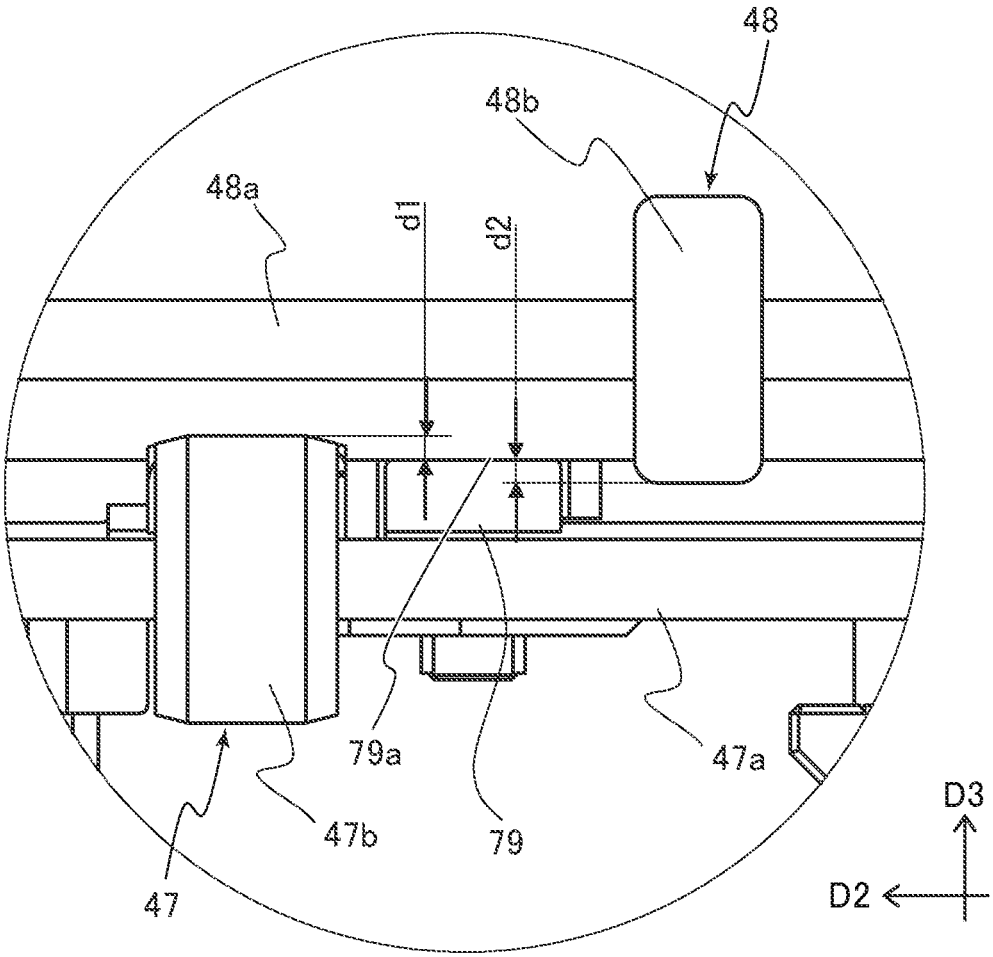
FIG. 4 is an enlarged view enlarging a part of a bundle discharge roller pair according to the first embodiment.

The bundle discharge unit 36 according to this embodiment is illustrated in FIGS. 2A, 2B, 3A, 3B, and 4. FIGS. 2A and 3A are perspective views showing a discharge roller pair 46 as a whole, and FIGS. 2B and 3B show enlarged views enlarging a part thereof. Further, FIG. 4 is a diagram showing a positional relationship of a discharge roller pair 46, and shows a state where a part of the bundle discharge unit 36 is viewed from a downstream side in the sheet conveyance direction.

As shown in FIGS. 2A and 3A, the bundle discharge unit 36 includes a unit frame 45, serving as a frame body, the discharge roller pair 46, serving as the discharger for discharging the sheet, and a bottom unit 95. The unit frame 45 is fastened to other frames constructing frame bodies of the post-processing apparatus 4, and constructs a part of the frame bodies of the post-processing apparatus 4. The discharge roller pair 46 is constructed by an upper roller 48 coming into contact with the upper surface of the sheet and a lower roller 47 coming into contact with the lower surface of the sheet. To be noted, only a part (support plates 79, 80, 81, and 82) of the bottom unit 95 is indicated in FIGS. 2A and 3A, and details of the bottom unit 95 will be described in another section.

In the following descriptions, a direction in which the discharge roller pair 46 discharges the sheet is referred to as a sheet discharge direction D1, and a sheet width direction perpendicular to the sheet discharge direction D1 is referred to as a sheet width direction D2. In particular, the sheet width direction D2 is a rotational axis direction of the lower and upper rollers 47 and 48 constructing the discharge roller pair 46. The sheet discharge direction D1 is, in a case viewed in the sheet width direction D2, a direction orthogonally intersecting with a height direction D3 connecting rotational axes of the lower and upper rollers 47 and 48. The height direction D3 is also a thickness direction of the sheet perpendicular to an in-plane direction of the sheet which passes through the discharge roller pair 46. Further, an upper side and a lower side in terms of the height direction D3 indicate an upper side (on a side of the upper roller 48 on a basis of the lower roller 47) and a lower side (on a side of the lower roller 47 on a basis of the upper roller 48) with respect to an imaginary plane spreading in the sheet discharge direction D1 and the sheet width direction D2. The upper side in terms of the height direction D3 and the lower side in terms of the height direction D3 are distinguished from an upper direction and a lower direction in terms of the vertical direction (gravity direction) in a case where the post-processing apparatus 4 is installed on the horizontal surface. The lower surface of the sheet indicates a sheet surface facing a stacking surface of lower discharge tray 37 and coming into contact with the lower roller 47 of the discharge roller pair 46. The upper surface of the sheet indicates a sheet surface opposite to the lower surface and coming into contact with the upper roller 48 of the discharge roller pair 46.

The sheet discharge direction D1 of this embodiment is, when viewed in the sheet width direction D2, a direction inclined upward in the vertical direction with respect to the horizontal direction. Further, one side (right hand side in FIG. 2A, left hand side in FIG. 3A) of the sheet width direction D2 is referred to as a front side of the post-processing apparatus 4, and the other side (left hand side in FIG. 2A, right hand side in FIG. 3) of the sheet width direction D2 is referred to as a rear side of the post-processing apparatus 4.

As shown in FIGS. 2A and 3A, the unit frame 45 includes a front frame 41, an upper frame 42, a rear frame 43, and a bottom frame 44, and each of the frames 41 to 44 is fixed by fasteners such as a screw. The front and rear frames 41 and 43 are plate shaped members facing each other in the sheet width direction D2 and spreading approximately perpendicularly with respect to the sheet width direction D2. The upper and bottom frames 42 and 44 are plate shaped members facing each other in the height direction D3 and extending in the sheet width direction D2 so as to couple the front and back frames 41 and 43 to each other.

These front, upper, rear, and bottom frames 41, 42, 43, and 44 are disposed so as to surround a second discharge path P4 (see FIG. 1), serving as a conveyance space through which the sheet discharged by the bundle discharge unit 36 passes. The discharge roller pair 46 is disposed in an opening portion of the conveyance space.

Support Configuration of Discharge Roller Pair

Both ends of a roller shaft 47*a* of the lower roller 47 of the discharge roller pair 46 is rotatably supported by the front and rear frames 41 and 43. On the other hand, the upper roller 48 is supported rotatably and movably in a direction moving to and away from the lower roller 47. In particular, as shown in FIGS. 2A to 3B, both ends in the sheet width direction D2 of a roller shaft 48*a* of the upper roller 48 are rotatably supported by roller support arms 50F and 50R (also refer to FIG. 5A). The roller support arm 50F on the front side is supported by the front frame 41 in a manner capable of swinging (see FIG. 2B), and the roller support arm 50R on the rear side is supported by the rear frame 43 in a manner capable of swinging (see FIG. 3B).

As shown in FIGS. 2B and 3B, pivot shafts 49F and 49R are fastened to the front and rear frames 41 and 43. Then, the pivot shafts 49F and 49R engage with holes in the roller support arms 50F and 50R, so that the roller support arms 50F and 50R swing around an axis extending in the sheet width direction D2 as the center. The roller support arms 50F and 50R pivot around a common axis as the center. Therefore, by the swings of the roller support arms 50F and 50R, the upper roller 48 moves to and is separated from the lower roller 47 along a circular arc track around the above axis as the center. Thereby, the discharge roller pair 46 is switched between a state of nipping and conveying the sheet between the upper and lower rollers 48 and 47 (nip state or closed state) and a state where the upper roller 48 is separated from the lower roller 47 (separated state or open state).

FIG. 4 shows an appearance of a part of the discharge roller pair 46 which is in the nip state, when viewed from a downstream side in the sheet discharge direction D1. The upper and lower rollers 48 and 47 include the roller shafts 48*a* and 47*a* extending in the sheet width direction D2, and roller bodies 48*b* and 47*b* fitted to the roller shafts 48*a* and 47*a*. When the discharge roller pair 46 nips and conveys the sheet, an outer peripheral surface of the roller body 48*b* of the upper roller 48 comes into contact with the upper surface of the sheet, and an outer peripheral surface of the roller body 47*b* of the lower roller 47 comes into contact with the lower surface of the sheet.

In this embodiment, the upper and lower rollers 48 and 47 respectively include a plurality of roller bodies 48*b* and 47*b*, and the plurality of roller bodies 48*b* of the upper roller 48 and the plurality of roller bodies 47*b* of the lower roller 47 are disposed alternately with each other with respect to the sheet width direction D2 (see FIGS. 2A and 3A). Further, when viewed from the downstream side in the sheet discharge direction D1, a lower edge of the plurality of roller bodies 48*b* of the upper roller 48 in the height direction D3 bite into a lower side of (i.e., are positioned below) the top edge of the plurality of roller bodies 47*b* of the lower roller 47 in the height direction D3. In other words, when viewed in the sheet width direction D2, the plurality of roller bodies 48*b* of the upper roller 48 and the plurality of roller bodies 47*b* of the lower roller 47 are disposed such that the outer peripheral surfaces of the plurality of roller bodies 48*b* and 47*b* partly overlap each other.

That is, the discharge roller pair 46 is a so-called comb-teeth roller pair. Since the comb-teeth roller pair is used for the discharge roller pair 46, it is possible to easily nip the sheet more strongly than a roller pair whose outer peripheral surfaces come into contact with each other, and possible to reduce a discharge defect more easily. However, it is acceptable to use the roller pair whose outer peripheral surfaces come into contact with each other. To be noted, a positional relationship between a support plate 79 and the roller bodies 47*b* and 48*b* in FIG. 4 will be described in another section.

Pressing/Separating Mechanism of Discharge Roller Pair

Next, a mechanism which generates a pressing force for nipping the sheet in the discharge roller pair 46 or separates the discharge roller pair 46 will be described. As shown in FIG. 2B, a pressing arm 51F capable of performing the relative rotation with respect to the roller support arm 50F, a pressing cam 90F for swinging the pressing arm 51F, and a tension spring 91F for urging the upper roller 48 are disposed on the front frame 41. A mechanism similar to the above is also disposed on the other side in the sheet width direction D2. That is, as shown in FIG. 3B, a pressing arm 51R capable of performing the relative rotation with respect to the roller support arm 50R, a pressing cam 90R for swinging the pressing arm 51R, and a tension spring 91R for urging the upper roller 48 are disposed on the rear frame 43.

As shown in FIGS. 2B and 3B, the pressing arms 51F and 51R each include a pressing side lever 51*a* and a separation side lever 51*b*, both of which come into contact with the pressing cams 90F and 90R, and a contact portion 51*c* coming into contact with each of the roller support arms 50F and 50R. The pressing arms 51F and 51R are pivotably supported with respect to the rear frame 43 around a pivot shafts 49F and 49R as the centers.

The pressing cams 90F and 90R are rotatably driven by a driving force supplied by a driving mechanism described below, and swing the pressing arms 51F and 51R by pressing the pressing side lever 51*a* or the separation side lever 51*b*. When the pressing cams 90F and 90R press the pressing side lever 51*a*, the pressing arms 51F and 51R swing in a pressing direction R1. When the pressing cams 90F and 90R press the separation side lever 51*b*, the pressing arms 51F and 51R swing in a separating direction R2.

The tension springs 91F and 91R are stretched between spring hook portions 50*a* of the roller support arms 50F and 50R and spring hook portions 51*d* of the pressing arms 51F and 51R. When the pressing arms 51F and 51R swing in the pressing direction R1, the tension springs 91F and 91R urge the roller support arms 50F and 50R so that the roller support arms 50F and 50R will follow the pressing arms 51F and 51R and swing in a pressing direction C1.

To be noted, on the front and rear frames 41 and 43, stoppers 41*a* and 43*a* for regulating a swing of the roller support arms 50F and 50R in the pressing direction C1 by coming into contact with the roller support arms 50F and 50R are disposed. When the pressing arms 51F and 51R swing in the separating direction R2, the contact portions 51*c* of the pressing arms 51F and 51R press the roller support arms 50F and 50R, and swing the roller support arms 50F and 50R in a separating direction C2.

Further, as shown in FIG. 2A, as a detection unit to detect a state of the discharge roller pair 46, a sensor S2 (separation home position sensor) transmitting a signal in accordance with a rotation angle of the pressing cam 90F is disposed. In this embodiment, a photo-interrupter to be shaded by a fan-shaped sensor flag 94 attached to a cam shaft 90A is used as the sensor S2. The sensor S2 includes a light emitting portion, such as a light-emitting diode (LED), emitting light and a light receiving portion, such as a photodiode, receiving the light from the light emitting portion. The sensor S2 changes a signal (such as a voltage value) transmitted from the light emitting portion corresponding to whether an optical path from the light emitting portion to the light receiving portion is blocked by the sensor flag 94 (light blocked state) or not blocked by the sensor flag 94 (light passing state). To be noted, as the other examples of the detection unit, it is acceptable to use a contact switch which is pressed by a protrusion disposed on the cam shaft 90A, or a rotary encoder which detects rotations of a disk attached to the cam shaft 90A.

Driving Configuration of Discharge Roller Pair

Next, a rotational movement of the discharge roller pair 46, and a configuration of supplying the driving force for the pressing/separating movement so as to switch the discharge roller pair 46 between a nip state and a separated state will be described. As described below, a plurality of components constructing a driving configuration are collectively disposed on the rear side of the bundle discharge unit 36.

As shown in FIG. 3A, a motor M2 serving as a driving source, and a drive transmitting unit that transmits a driving force of the motor M2 to the roller shafts 47*a* and 48*a* and the pressing cams 90F and 90R described above are supported on the rear frame 43.

The drive transmitting unit includes a stepped gear (or combination gear) 57 for transmitting a rotation of an output shaft of the motor M2 in a decelerating manner, and a pendulum gear unit 58A for switching a transmission path of the driving force. The pendulum gear unit 58A includes a sun gear 58 engaging with the stepped gear 57, a gear holder 59 swinging around a rotational axis of the sun gear 58 as the center, and a planet gear 61 rotatably supported by the gear holder 59 and engaging with the sun gear 58. The gear holder 59 is pressed to a side surface of the sun gear 58 by a torque spring 60 composed of a plate spring, and swings in the same direction as a rotation direction of the sun gear 58 by a friction force received from the sun gear 58. When the motor M2 rotates in a first direction, the gear holder 59 moves to a position where the planet gear 61 engages with a separation gear 62. When the motor M2 rotates in a second direction opposite to the first direction, the gear holder 59 moves to a position where the planet gear 61 engages with a conveyance gear 66.

The separation gear 62 is coupled to a cam drive gear 65 disposed on the same shaft as the pressing cam 90R through gears 63 and 64 (see FIG. 3B). Further, the pressing cam 90R is coupled to the pressing cam 90F on a side of the front frame 41 through the cam shaft 90A (see FIG. 3A). Therefore, when the motor M2 rotates in the first direction, the pressing cams 90F and 90R are rotatably driven by the driving force from the motor M2, the pressing/separating mechanism described above is operated. In this case, a rotary drive of the discharge roller pair 46 is not performed.

The conveyance gear 66 is coupled to a drive pulley 70 through gears 67, 68, and 69. The drive pulley 70 is coupled to an intermediate pulley 72 through a timing belt 74. Further, the intermediate pulley 72 is coupled to a driven pulley 73 fixed on the roller shaft 48*a* of the upper roller 48 through a timing belt 75. Further, the gear 69 described above is fixed on the roller shaft 47*a* of the lower roller 47. Therefore, when the motor M2 rotates in the second direction, the upper and lower rollers 48 and 47 are rotatably driven by the driving force from the motor M2. In this case, the pressing/separating movement of the discharge roller pair 46 is not performed.

To be noted, the intermediate pulley 72 described above is disposed on the same shaft as a pivot shaft 49R that is a swing shaft of the roller support arm 50R. Thereby, since a distance between the intermediate pulley 72 and the driven pulley 73 on the roller shaft 48*a* does not change even in a case where the roller shaft 48*a* of the upper roller 48 moves by the swing of the roller support arm 50R, a drive transmission by the timing belt 75 is enabled.

Further, while, in this embodiment, the rotary drive and the driving force of the pressing/separating movement of the discharge roller pair 46 are supplied by a single motor of the motor M2, it is acceptable to dispose driving sources for the rotary drive and the pressing/separating movement separately. For instance, it is acceptable to perform the pressing/separating movement of the discharge roller pair 46 by swinging the roller support arms 50F and 50R by a solenoid.

Pressing/Separating Movement of Discharge Roller Pair

Using FIGS. 5A to 5E, the pressing/separating movement to switch the discharge roller pair 46 to the nip state and the separated state will be described. FIGS. 5A to 5D are, when viewed in the sheet width direction D2, schematic views showing positional relationships of members relating to the pressing/separating movement of the discharge roller pair 46. To be noted, while only members on the side of the front frame 41 are illustrated in FIGS. 5A to 5D, members on a side of the rear frame 43 (roller support arm 50R, pressing arm 51R, pressing cam 90R, and tension spring 91R) are located at positions overlapping the respective members on the side of the front frame 41 when viewed in the sheet width direction D2.

Figure 5A:
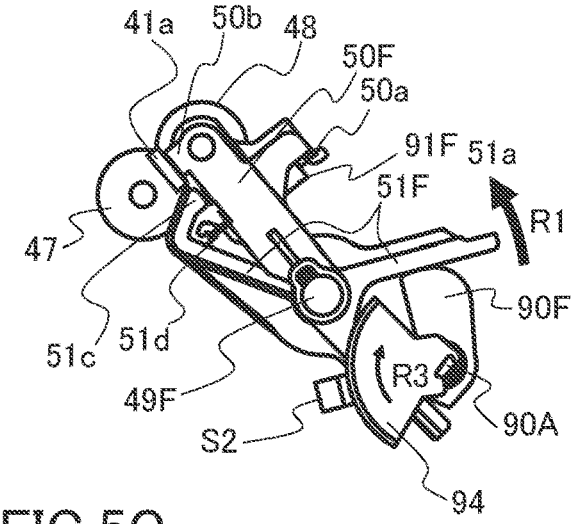
FIGS. 5A to 5D are diagrams each illustrating a pressing/separating movement of the bundle discharge roller pair according to the first embodiment.
Figure 5B:
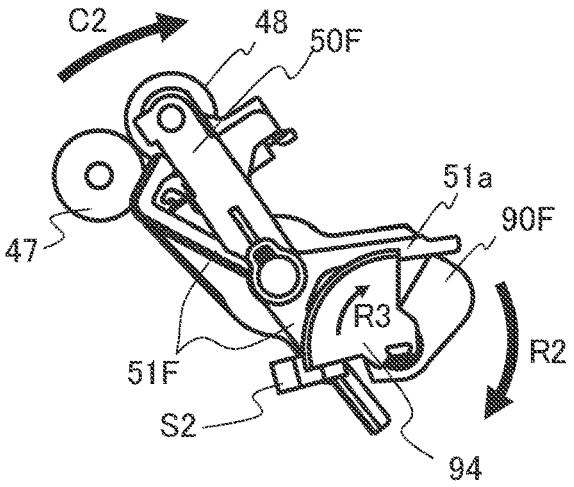
Figure 5C:
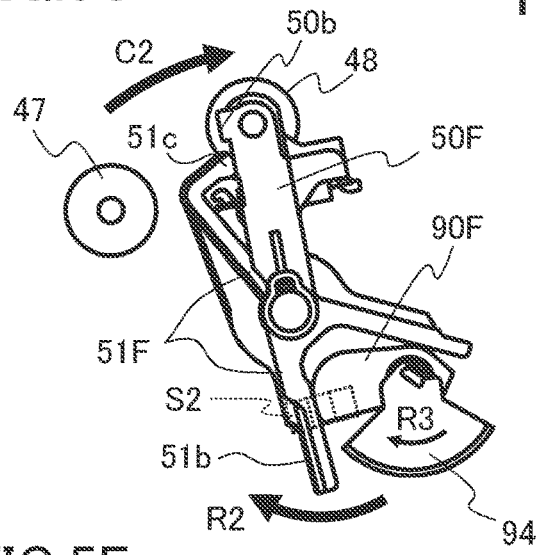
Figure 5D:
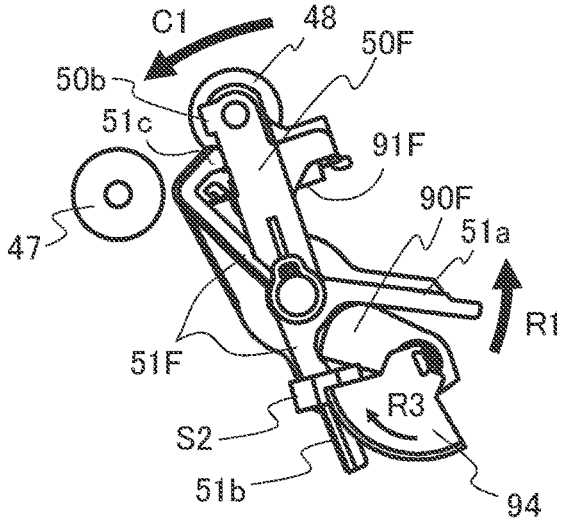
Figure 5E:
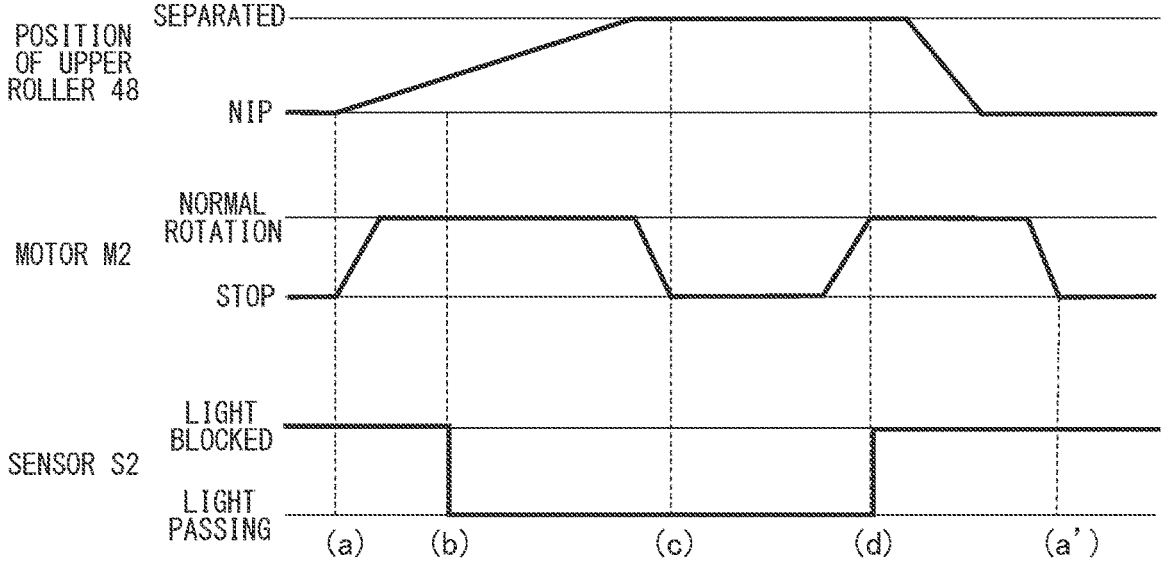
FIG. 5E is a timing chart of the pressing/separating movement of the bundle discharge roller pair.

FIG. 5E is a timing chart showing an operation state of each unit until switching the discharge roller pair 46 over to the nip state again after a switch to the separated state. In the timing chart, the horizontal axis shows time, and the vertical axis shows, with respect to the upper roller 48, positions relative to the lower roller 47, with respect to the motor M2, rotation speeds, and, with respect to the sensor S2, whether it is in the light passing state or the light blocked state. Further, (a) to (d) in the timing chart correspond to the respective states shown in FIGS. 5A to 5D. To be noted, a controller of the image forming apparatus 1 realizes the following movements by controlling a rotation of the motor M2 based on the signal transmitted by the sensor S2.

1. Nip State (FIG. 5A)

FIG. 5A shows a state where the discharge roller pair 46 is in the nip state, that is, a state where the upper roller 48 is located in a position moving to the lower roller 47 most.

At this time, the pressing cam 90F comes into contact with the pressing side lever 51*a* of the pressing arm 51F, and presses the pressing arm 51F in the pressing direction R1. Since the roller support arm 50F is coupled to the pressing arm 51F through the tension spring 91F, the roller support arm 50F is urged in the pressing direction C1, and, since a locking portion 50*b* engages with the stopper 41*a*, a movement of the roller support arm 50F in the pressing direction C1 is regulated. Thereby, the roller support arm 50F is positioned, and the discharge roller pair 46 becomes the nip state (refer to FIG. 4). In the nip state of the discharge roller pair 46, the separation HP (home position) sensor is in the light blocked state (see (a) in FIG. 5E).

To be noted, in a case where the sheet is nipped between the upper and lower rollers 48 and 47, depending on stiffness of the sheet, the discharge roller pair 46 is sometimes brought into a slightly opened state by a reaction force received by the upper roller 48. Especially, in a case of nipping the sheet with the high stiffness or the sheet bundle with a large number of sheets, the upper roller 48 is lifted from an original nip position (see FIG. 4) and becomes easily separated from the lower roller 47. That is, even if the pressing cam 90F and the pressing arm 51F are in the positions shown in FIG. 5A, when the upper roller is lifted by the sheet, in some cases, resisting the urging force of the tension spring 91F, the locking portion 50*b* of the roller support arm 50F is separated from the stopper 41*a*. The state described above is included in the "nip state" since, if the pressing arm 51F is positioned properly, the sheet is nipped between the upper and lower rollers 48 and 47.

As described above, the strength of a pressing force with which the discharge roller pair 46 nips the sheet is determined by a spring constant of the tension spring 91F and an elongation amount in the nip state. Since, in a case where the upper roller 48 is farther separated from the lower roller 47 than a position shown in FIG. 5A in the nip state, the elongation amount of the tension spring 91F enlarges, the pressing force of the discharge roller pair 46 is increased. Thereby, it is possible for the discharge roller pair 46 to stably convey the sheet with the high stiffness (for example, cardboard and corrugated cardboard) and the sheet bundle with the large number of sheets.

2. State Transition of Sensor (FIG. 5B)

When the motor M2 is started from the state shown in FIG. 5A and the pressing cam 90F and the sensor flag 94 rotate by a predetermined angle (in this embodiment, 45°) in an arrow R3 direction, the sensor flag 94 passes through the sensor S2. Thereby, the sensor S2 changes from a first state of the light blocked state to a second state of the light passing state ((b) in FIG. 5E).

3. Separated State (FIG. 5C)

When the pressing cam 90F and the sensor flag 94 further rotate by a predetermined angle (in this embodiment, 224.5°) in the arrow R3 direction after the sensor S2 has been switched from the light blocked state to the light passing state, the motor M2 stops ((c) in FIG. 5E). Meanwhile, having separated from the pressing side lever 51*a* of the pressing arm 51F, the pressing cam 90F comes into contact with the separation side lever 51*b*, and pivots the pressing arm 51F in the separating direction R2. Then, the contact portion 51*c* of the pressing arm 51F comes into contact with the roller support arm 50F, and the roller support arm 50F pivots along with the pressing arm 51F in the separating direction C2. Thereby, the locking portion 50*b* of the roller support arm 50F is separated from the stopper 41*a*, and the upper roller 48 supported by the roller support arm 50F moves in the separating direction C2, so that the upper roller 48 is separated from the lower roller 47.

The motor M2 stops in a state where the upper roller 48 is in a position separated from the lower roller 47 most, that is, in the separated state of the discharge roller pair 46. In this embodiment, in a case where the discharge roller pair 46 receives the sheet, the discharge roller pair 46 is brought into the separated state before the leading edge of the sheet (the downstream edge in the sheet discharge direction D1) reaches the discharge roller pair 46.

Since, in the separated state of the discharge roller pair 46, the pressing cam 90F comes into contact not with the pressing side lever 51*a* but with the separation side lever 51*b*, the pressing cam 90F does not receive the urging force of the tension spring 91F (a force which works so as to pivot the pressing arm 51F in the pressing direction R1). The pressing cam 90F becomes to only receive the moment generated around the pivot shaft 49 by the upper roller 48, the roller support arm 50F, the pressing arm 51F, and the own weight of the tension spring 91F.

4. State Transition of Sensor (FIG. 5D)

When the motor M2 is started to rotate in the first direction in the separated state shown in FIG. 5C and the pressing cam 90F and the sensor flag 94 rotate by a predetermined angle (in this embodiment, 30.5°) in the arrow R3 direction, the sensor flag 94 reaches the sensor S2. Thereby, the sensor S2 changes from the second state of the light passing state to the first state of the light blocked state ((d) in FIG. 5E).

When the pressing cam 90F and the sensor flag 94 rotate by a predetermined angle (in this embodiment, 60°) in the arrow R3 direction after the sensor S2 has switched from the light passing state to the light blocked state, the motor M2 stops ((a') in FIG. 5E). Meanwhile, the pressing cam 90F presses the pressing side lever 51*a* of the pressing arm 51F, and pivots the pressing arm 51F in the pressing direction R1. The roller support arm 50F pivots in the pressing direction C1 by being pulled by the pressing arm 51F through the tension spring 91F. Thereby, the upper roller 48 supported by the roller support arm 50F moves in the pressing direction C1, and approaches the lower roller 47.

The motor M2 stops in the state shown in FIG. 5A where the pressing arm 51F is moved to an end position in the pressing direction R1. To be noted, before the motor M2 stops, the roller support arm 50F has been stopped pivoting by the contact of the locking portion 50*b* with the stopper 41*a* or the contact of the upper roller 48 with an upper surface of the sheet. Thereby, the discharge roller pair 46 returns to the nip state shown in FIG. 5A. As described above, a nip operation and a separation operation are repeatedly performed by the rotation of the motor M2 along the process shown in FIGS. 5A to 5D.

Bottom Unit

Figure 6A:
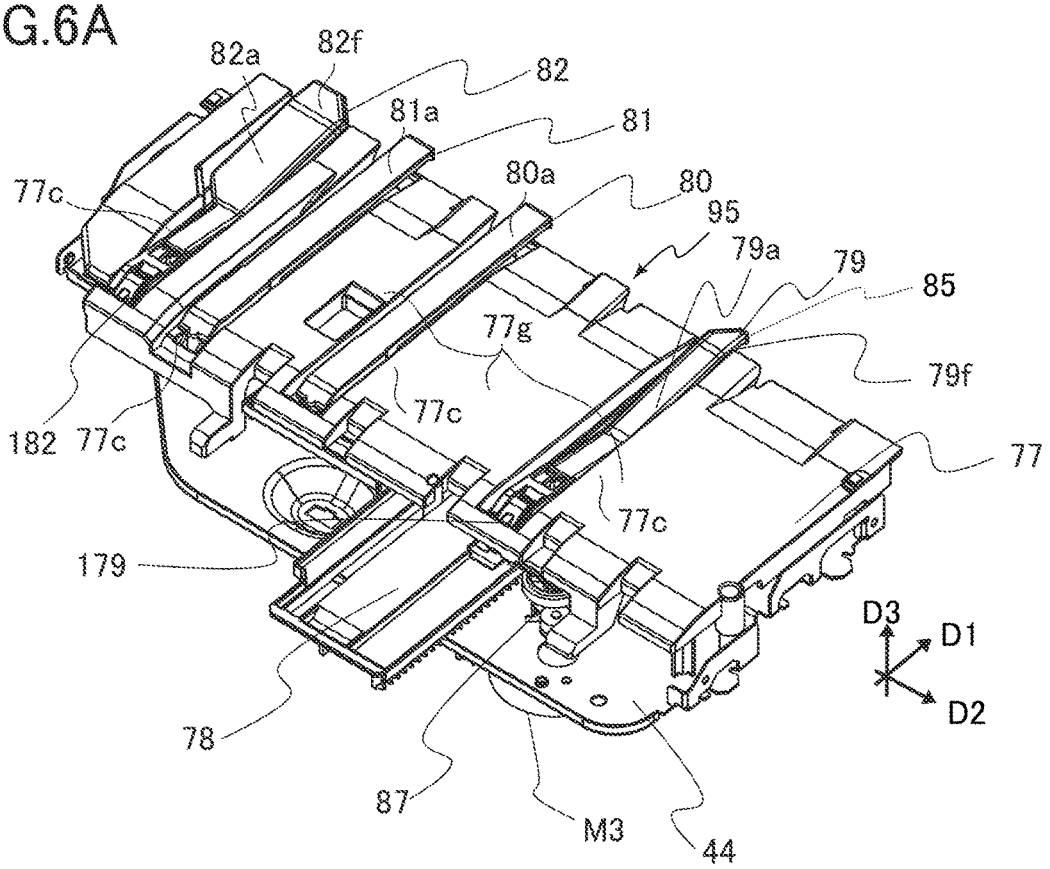
FIGS. 6A and 6B are perspective views each showing a bottom unit according to the first embodiment.
Figure 6B:
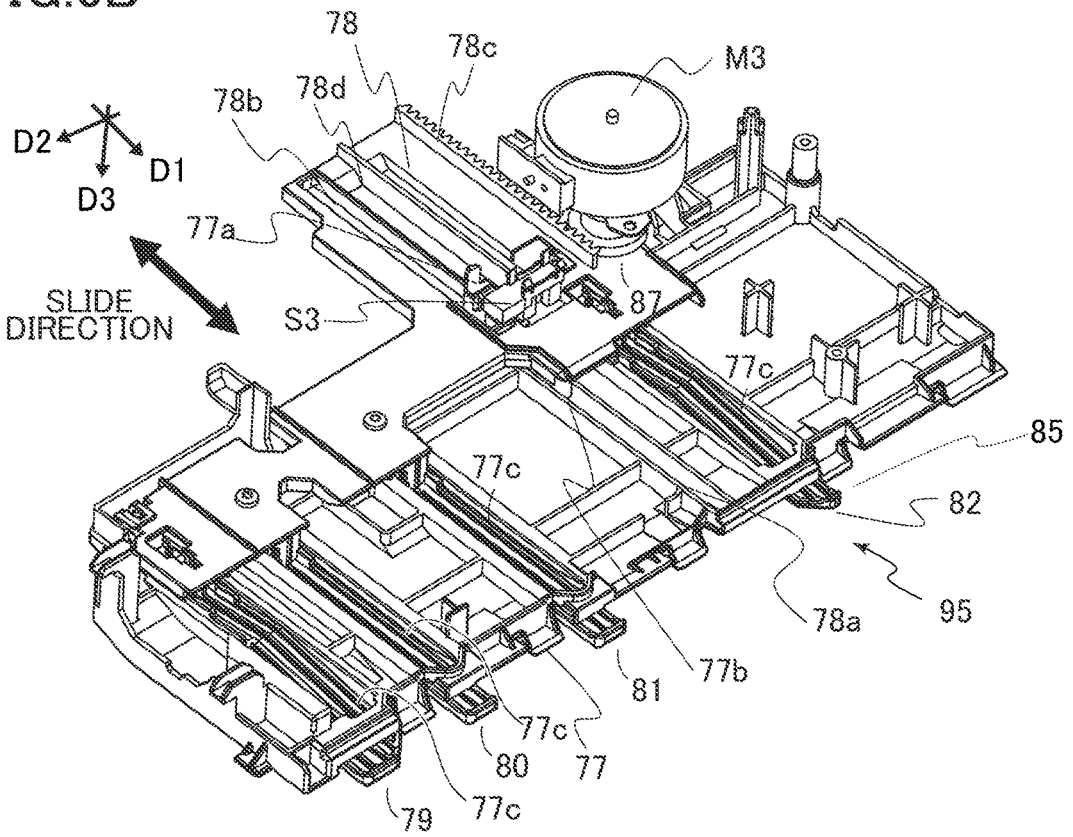

Next, using FIGS. 6A and 6B, the bottom unit 95 that the bundle discharge unit 36 includes will be described. FIG. 6A is a perspective view of the bottom unit 95 when viewed from above in the height direction D3 (from a side of the conveyance space in which the sheet is conveyed), and FIG. 6B is a perspective view of the bottom unit 95 when viewed from below in the height direction D3. To be noted, the bottom unit 95 is supported by the bottom frame 44 of the bundle discharge unit 36, and the illustration of the bottom frame 44 is omitted in FIG. 6B.

The bottom unit 95 includes a conveyance lower guide 77, a plurality of support plates 79, 80, 81, and 82, a support plate holder 78, a sensor S3, and a motor M3.

The conveyance lower guide 77 is fastened to the bottom frame 44 by a screw, not shown. That is, the conveyance lower guide 77 is fixed to a frame body of the bundle discharge unit 36 (and a frame body of the post-processing apparatus 4). The conveyance lower guide 77 faces the lower surface of the sheet conveyed toward the discharge roller pair 46, and serves, in this embodiment, as a guide member guiding the sheet to the discharge roller pair 46. The conveyance lower guide 77 includes a guide surface 77*g* inclined with respect to the horizontal direction along the sheet discharge direction D1 of the discharge roller pair 46 (also refer to FIG. 7B). The guide surface 77*g* serves as a guide portion guiding the sheet by facing the lower surface of the sheet. When viewed in the sheet width direction D2, an inclination angle of the guide surface 77*g* is set, for example, at substantially the same as the sheet discharge direction D1.

Further, the inclination angle of the guide surface 77*g* of the conveyance lower guide 77 is set at an angle close to (preferably the same angle except a tolerance and the like) an inclination angle of a conveyance lower guide 32 (see FIG. 1) of the intermediate stacking unit 35 located further upstream in the sheet discharge direction D1. Therefore, in this embodiment, an upper surface of the stacking lower guide 32, on which the sheet bundle is formed, and the guide surface 77*g* of the conveyance lower guide 77 are disposed on the same straight line extending in the sheet discharge direction D1 when viewed in the sheet width direction D2. Further, upper surfaces of the support plates 79 to 82 (in particular, upper surfaces of the inside support plates 80 and 81) are disposed along the straight line described above. Since, it is not necessary to bend the sheet on the conveyance path in this configuration, it is advantageous in a case handling the sheet bundle with the large number of sheets of the sheet or handling the sheet with the high stiffness.

In this embodiment, as the plurality of support plates 79 to 82, a first support plate 79, a second support plate 80, a third support plate 81, and a fourth support plate 82 are disposed in sequence from the rear side toward the front side in the sheet width direction D2. Each of the support plates 79 to 82 is an elongated plate shaped (or rodlike) member extending in the sheet discharge direction D1. Upper surfaces 79*a*, 80*a*, 81*a*, and 82*a* of the respective support plates 79 to 82 are exposed to above in the height direction D3 through grooves 77*c* (slits, openings) disposed in the conveyance lower guide 77 in the sheet discharge direction D1.

In a case where the A4 size sheet (A4 sheet), which is a typical sheet size, is discharged in the long edge feed orientation, the support plates 79 and 82 are respectively disposed on one side and the other side with respect to the central position WO (see FIG. 9) of the sheet in the sheet width direction D2. Preferably, in a case where the A4 sheet is divided into three or four equal parts in the sheet width direction D2, the support plates 79 and 82 are disposed in areas of both outsides so that the support plates 79 and 82 support adjacent to the side edges of the sheet. The support plates 79 and 82 are examples of a first moving member and a second moving member disposed separately from each other in the sheet width direction D2. The support plate 80 is an example of a third moving member disposed between the first and second moving members in the sheet width direction D2. The support plate 81 is an example of a fourth moving member disposed between the third and second moving members in the sheet width direction D2.

The support plates 79 to 82 are all supported by the support plate holder 78 extending in the sheet width direction D2 below the conveyance lower guide 77 in the height direction D3. The conveyance lower guide 77 includes a boss 77*b* that is a protrusion portion, and a groove 77*a* extending in the sheet discharge direction D1. The support plate holder 78 includes a groove 78*a* extending in the sheet discharge direction D1 and engaged with the boss 77*b* of the conveyance lower guide 77, and a boss 78*b* that is a protrusion engaging with the groove 77*a* of the conveyance lower guide 77. Thereby, the support plate holder 78 is slidably supported with respect to the conveyance lower guide 77 along the sheet discharge direction D1. Further, the support plates 79 to 82, serving as an integrated support plate unit 85 supported by the support plate holder 78, are slidable with respect to the conveyance lower guide 77 along the sheet discharge direction D1.

The inside support plates 80 and 81 in the sheet width direction D2 among the support plates 79 to 82 are fastened to the support plate holder 78 by a screw, not shown, and fixed to the support plate holder 78. The support plates 79 and 82 on both outsides in the sheet width direction D2 are pivotably attached to the support plate holder 78 through holding members 179 and 182. Detailed configurations of the support plates 79 to 82 will be described in another section.

The motor M3 that is a driving source for moving the support plate unit 85 is coupled to the support plate holder 78 through a stepped gear 87. In particular, the first gear of the stepped gear 87 engages with an output gear of the motor M3, and the second gear of the stepped gear 87 engages with a rack 78*c* disposed on the support plate holder 78 extending in the sheet discharge direction D1. Therefore, the support plate holder 78 moves upstream or downstream in the sheet discharge direction D1 in accordance with a rotation direction and a rotation amount of the motor M3.

Hereinafter, a most upstream position within a moving area of the support plate unit 85 in the sheet discharge direction D1 (the position shown in FIGS. 6A, 6B, and 7A) is referred to as a storage position of the support plate unit 85. Further, a most downstream position within a moving area of the support plate unit 85 in the sheet discharge direction D1 (the position shown in FIG. 7B) is referred to as a protruding position of the support plate unit 85. Still further, positions of the support plates 79 to 82 corresponding to the storage position and the protruding position of the support plate unit 85 are referred to as storage positions and protruding positions of the support plates 79 to 82. The protruding position is a first position of this embodiment, and the storage position is a second position of this embodiment.

Further, the sensor S3 that is a detection unit for controlling a position of the support plate unit 85 is attached to the bottom frame 44 by a means of a snap-fit and the like. In this embodiment, a photo-interrupter whose light can be blocked by a light block rib 78*d* formed on the support plate holder 78 is used as the sensor S3. The sensor S3 includes a light emitting portion, such as an LED, emitting light and a light receiving portion, such as a photodiode, receiving the light from the light emitting portion. The sensor S3 changes a signal (such as a voltage value) transmitted from the light emitting portion depending on whether an optical path from the light emitting portion to the light receiving portion is blocked by the light block rib 78*d* (light blocked state) or not blocked by the light block rib 78*d* (light passing state). In this embodiment, when the support plate unit 85 is in the storage position, the sensor S3 becomes the light passing state, and, when the support plate unit 85 is in the protruding position, the sensor S3 becomes the light blocked state.

Detail of Support Plate

Figure 7A:
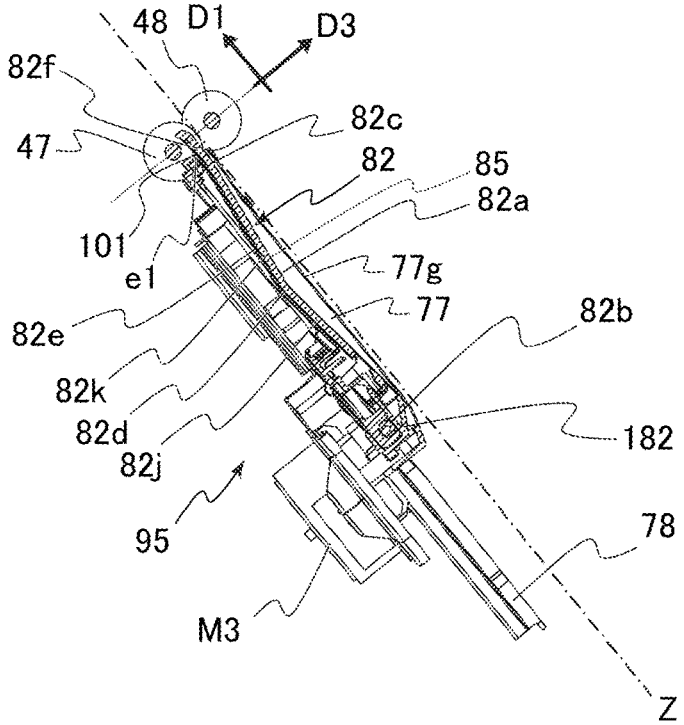
FIGS. 7A and 7B are cross-sectional views each showing the bundle discharge unit according to the first embodiment.
Figure 7B:
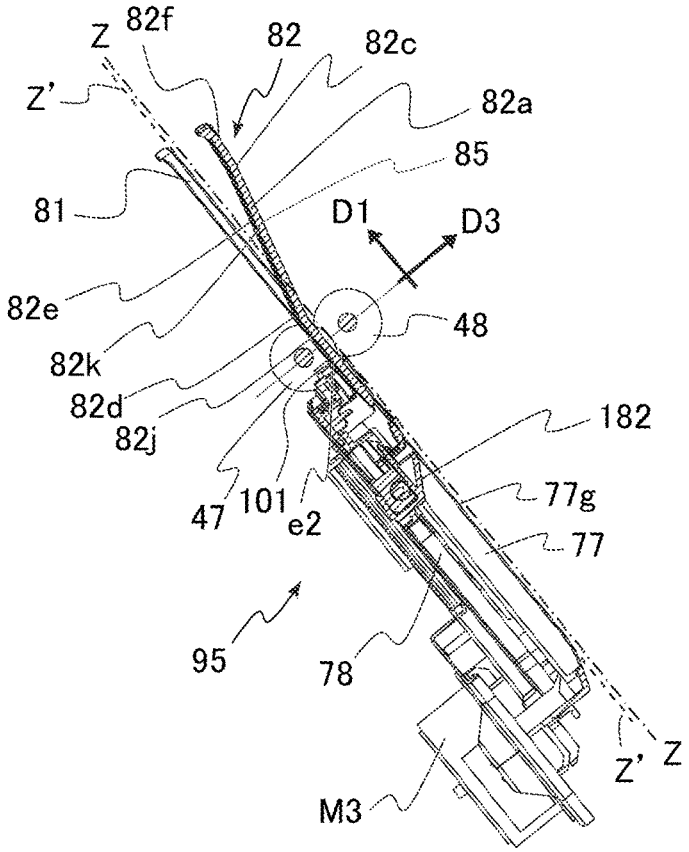
Figure 8:
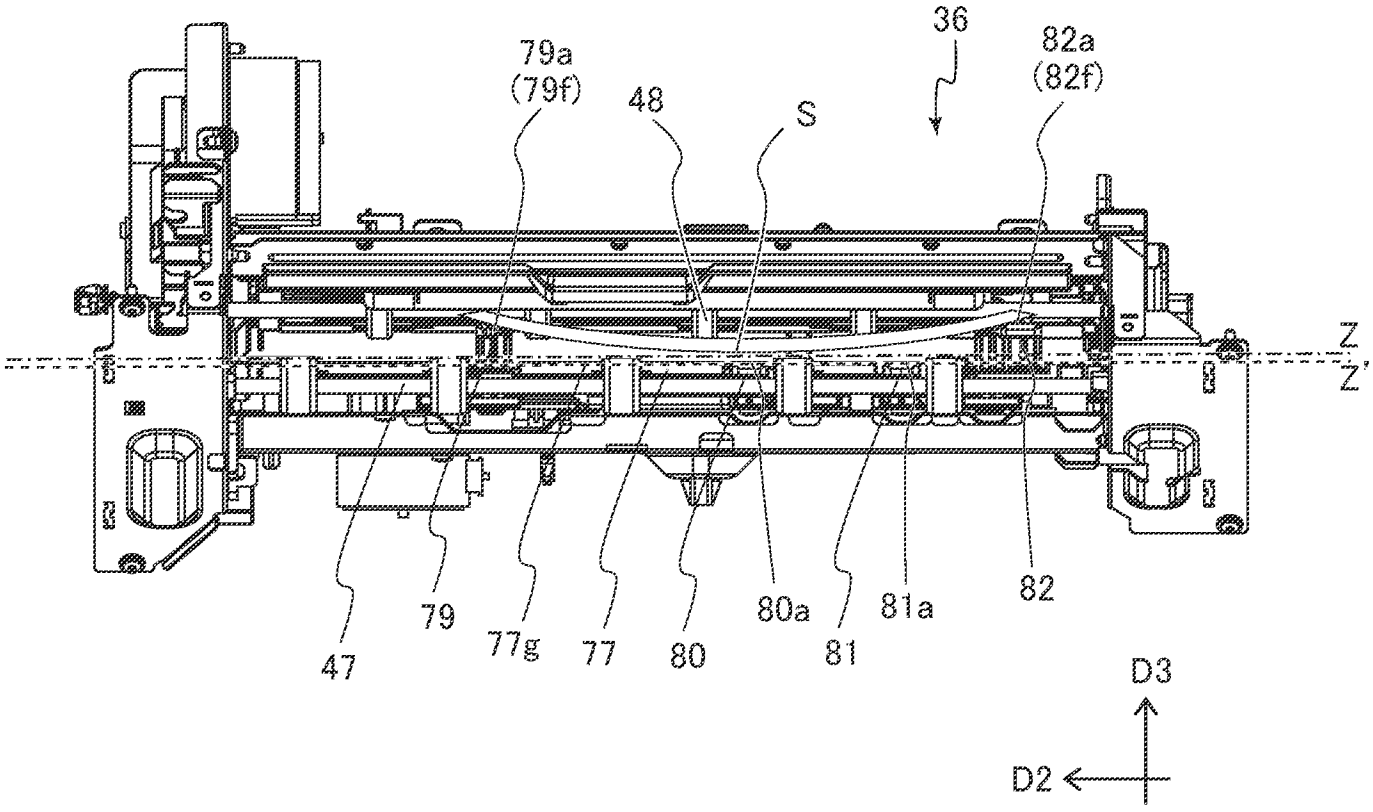
FIG. 8 is a diagram showing the bundle discharge unit according to the first embodiment and a sheet bundle in the middle of discharge when viewed from a downstream side in a sheet discharge direction.

Next, using FIGS. 7A and 7B and FIGS. 8 to 10B, configurations of the support plates 79 to 82 will be described in detail. FIGS. 7A and 7B show a cross-sectional view of the bottom unit 95 upon an imaginary plane perpendicular to the sheet width direction D2 and passing through the support plate 82. FIG. 7A shows a state where the support plates 79 to 82 are in the storage position, and FIG. 7B shows a state where the support plates 79 to 82 are in the protruding position. FIG. 8 is a diagram showing the bundle discharge unit 36 which is in the middle of discharging a sheet bundle S, when viewed from a downstream side in the sheet discharge direction D1.

At first, the configurations of the support plates 79 and 82 on both outsides will be described. Here, while descriptions will be provided by using the support plate 82 on the front side, the support plate 79 on the rear side is constructed substantially the same.

As shown in FIGS. 7A and 7B, the support plate 82 includes a pivot shaft 82*b* at the upstream end in the sheet discharge direction D1 and pivotably supported by the support plate holder 78 and the holding member 182, and extends in the sheet discharge direction D1 from the pivot shaft 82*b*. Around the pivot shaft 82*b* as the center, the support plate 82 is capable of swinging around an axis extending in the sheet width direction D2. Thereby, the support plate 82 swings with respect to the conveyance lower guide 77 so that the downstream end thereof in the sheet discharge direction D1 can change a position in the height direction D3.

The conveyance lower guide 77 includes a contact portion 101 coming into contact with a lower surface 82*e* that is a lower side surface of the support plate 82 in the height direction D3. The contact portion 101 has a convex or protruded shape protruding upward in the height direction D3 at the downstream end of the conveyance lower guide 77 in the sheet discharge direction D1. An upper end of the contact portion 101 in the height direction D3 is lower than an upper edge of the lower roller 47. That is, the contact portion 101 is located below a tangent Z of the lower roller 47 in the height direction D3. The tangent Z is an imaginary straight line that is tangent to an outer peripheral surface of the roller body 47*b* of the lower roller 47, extends in parallel with the guide surface 77*g* of the conveyance lower guide 77, and passes above a rotational axis of the lower roller 47. The tangent Z can also be said as an imaginary straight line that is tangent to the outer peripheral surface of the roller body 47*b* of the lower roller 47, extends in the sheet discharge direction D1, and passes above the rotational axis of the lower roller 47. Further, the tangent Z is located slightly above an extended line Z' of the guide surface 77*g* of the conveyance lower guide 77.

Further, the contact portion 101 is disposed adjacent to the lower roller 47. In this embodiment, the contact portion 101 is disposed upstream of the rotational axis of the lower roller 47 in the sheet discharge direction D1, and in a position, when viewed in the sheet width direction D2, overlapping the roller body 47*b* of the lower roller 47. With this disposition of the contact portion 101, it is possible to compactly dispose a configuration for swinging the support plates 79 and 82 in the height direction D3, as described below.

A shape of the support plate 82 will be described in detail. Within a lower surface 82*e* of the support plate 82, a portion with which the contact portion 101 comes into contact in a state where the support plate 82 is in the storage position is referred to as a first contacted portion e1, and a portion with which the contact portion 101 comes into contact in a state where the support plate 82 is in the protruding position is referred to as a second contacted portion e2. The first contacted portion e1 is located downstream of the second contacted portion e2 in the sheet discharge direction D1.

The support plate 82 includes an inclined portion 82*k* between the first and second contacted portions e1 and e2. In the storage state of the support plate 82 shown in FIG. 7A, a lower surface 82*e* of the inclined portion 82*k* is inclined with respect to the sheet discharge direction D1 so that the lower surface 82*e* is inclined downward in the height direction D3 toward the upstream side in the sheet discharge direction D1. Therefore, along with a movement of the support plate 82 from the storage position to the protruding position, the lower surface 82*e* of the inclined portion 82*k* climbs on the contact portion 101, and the support plate 82 pivots so that a tip portion 82*f* of the support plate 82 moves upward in the height direction D3.

In the state (protruding state) shown in FIG. 7B, where the support plate 82 is in the protruding position, the second contacted portion e2 of the lower surface 82*e* comes into contact with the contact portion 101, and at least the tip portion 82*f* of the support plate 82 protrudes upward in the height direction D3 with respect to the tangent Z. Further, in the protruding state of the support plate 82, the inclined portion 82*k* is inclined upward in the height direction D3 toward the downstream side in the sheet discharge direction D1. Upper surfaces of the inclined portion 82*k* and the tip portion 82*f* have a function to bend the sheet discharged by the discharge roller pair 46 so that the sheet would form a curved shape, as described in another section.

Here, regardless of a case, whether the support plate 82 is in the storage position or in the protruding position, a position of an upper surface 82*a* of the support plate 82 in the height direction D3 on a line connecting the rotational axes of the upper and lower rollers 48 and 47 of the discharge roller pair 46 is lower than the upper edge of the outer peripheral surface of the lower roller 47. In particular, the contact portion 101 is disposed in a position separated from the tangent Z to the lower side in the height direction D3 by a distance larger than the thickness of the support plate 82 at positions of the first and second contacted portions e1 and e2. More preferably, the contact portion 101 is disposed in a position separated from the tangent Z to the lower side in the height direction D3 by a distance larger than the maximum thickness of the support plate 82 between the first and second contacted portions e1 and e2. With this configuration, the support plate 82 is prevented from protruding in the height direction D3 from the lower roller 47, and the contact pressure between the lower roller 47 and sheet is secured, so that the discharge roller pair 46 is allowed to more stably nip and convey the sheet easily.

Here, the support plate 82 includes an upstream portion 82*j* and a downstream portion (the tip portion 82*f*), which are bent with respect to the inclined portion 82*k*, on upstream and downstream sides in the sheet discharge direction D1. In the protruding state of the support plate 82, when viewed in the sheet width direction D2, both of the upstream portion 82*j* and the tip portion 82*f* extend at an angle closer (including an identical case) to the sheet discharge direction D1 than the inclined portion 82*k*. The upstream portion 82*j* extends in a direction along the guide surface 77*g* of the conveyance lower guide 77.

In view of bending the sheet discharged by the discharge roller pair 46 so as to form the curved shape by the support plate 82 and promptly lowering the height of the support plate 82 at a time of storing the support plate 82, it is suitable that a proportion of the length Lk of the inclined portion 82*k* to the protrusion length L of the support plate 82 is large. In particular, the distance from the rotational axis of the lower roller 47 to a position of the tip portion of the support plate 82 in the protruding position in the sheet discharge direction D1 is referred to as the protrusion length L. Further, the distance from a bending portion 82*d* (first bending portion) between the upstream portion 82*j* and the inclined portion 82*k* to a bending portion 82*c* (second bending portion) between the inclined portion 82*k* and the tip portion 82*f* in the sheet discharge direction D1 is referred to as the length Lk of the inclined portion 82*k*. At this time, it is acceptable if Lk is equal to or more than a half of L (preferably, equal to or more than two-thirds). To be noted, in a case where a configuration other than the configuration of the discharge roller pair 46 is used for a discharger, as a reference of the protrusion length L, it is possible to use a most downstream position in the sheet discharge direction D1 within an area in which the discharger applies a conveyance force to the sheet in the sheet discharge direction D1.

With a configuration similar to the support plate 82 described above, the support plate 79 on the rear side also swings so that a tip portion 79*f* would moves in the height direction D3 at a time when the support plate 79 slidingly moves between the storage and protruding positions along the sheet discharge direction D1. In a case where the support plate 79 is in the protruding position, the tip portion 79*f* (see FIG. 6B) protrudes upward in the height direction D3 with respect to the tangent Z. Further, regardless of a case, whether the support plate 79 is in the storage position or in the protruding position, a position of an upper surface 79*a* of the support plate 79 in the height direction D3 on the line connecting the rotational axes of the upper and lower rollers 48 and 47 of the discharge roller pair 46 is lower than the upper edge of the outer peripheral surface of the lower roller 47.

Incidentally, as shown in FIG. 4, the support plate 79 is disposed in an area between the roller bodies 48*b* and 47*b* of the upper and lower rollers 48 and 47, which are adjacent to each other in terms of the sheet width direction D2. Upon a cross-section perpendicular to the sheet discharge direction D1 passing through the rotational axes of the upper and lower rollers 48 and 47, the distance between the upper edge of the roller body 47*b* and an upper surface 79*a* of the support plate 79 in the height direction D3 is referred to as d1. Upon the same cross-section, the distance between the lower edge of the roller body 48*b* of the upper roller 48 and the upper surface 79*a* of the support plate 79 in the height direction D3 is referred to as d2. In this case, the support plate 79 is disposed, preferably, in a position where d1 is approximately equal to d2. The support plate 82 on the most forward side is also disposed, preferably, in a position where d1 is approximately equal to d2 in terms of the similar distance d1 and d2.

As shown in FIG. 8, the support plates 80 and 81 are disposed in an area between the roller bodies 48*b* and 47*b* of the upper and lower rollers 48 and 47, which are adjacent to each other in terms of the sheet width direction D2. The support plate 82 that is located on the most forward side is positioned forward to a roller on a most forward side among the roller bodies 47*b* and 48*b*. Therefore, the support plates 79 to 82 are all in positions not overlapping with the roller bodies 47*b* or 48*b* of the lower and upper rollers 47 or 48 in the sheet width direction D2. Further, the support plates 80 and 81 are, preferably, similar to the support plates 79 and 82, disposed in a position where d1 is approximately equal to d2.

Here, as shown in FIG. 7B, at least in a state where the support plates 79 to 82 are in the protruding position, upper surfaces 80*a* and 81*a* of the inside support plates 80 and 81 are located below in the height direction D3 with respect to the tip portions 79*f* and 82*f* of the support plates 79 and 82. Preferably, the wholes of the upper surfaces 80*a* and 81*a* of the inside support plates 80 and 81 are located below in the height direction D3 with respect to the tangent Z.

As described above, in a case where the support plates 79 to 82 are located in the protruding position, while the tip portions 79*f* and 82*f* of the support plates 79 and 82 protrude upward with respect to the tangent Z of the lower roller 47 in the height direction D3, the inside support plates 80 and 81 are located below the tip portions 79*f* and 82*f* Since this positional relationship does not depend on a position of the upper roller 48, it is not affected by whether the discharge roller pair 46 is in the nip state or the separated state.

As shown in FIG. 8, in a case where the sheet bundle S discharged by the discharge roller pair 46 is viewed in the sheet discharge direction D1, because of the support by the support plates 79 to 82, the sheet bundle S forms the curved shape protruding downward. That is, the sheet bundle S is supported by the support plates 79 to 82 in the curved state in which the central portion of the sheet bundle S in the sheet width direction D2 protrudes downward with respect to both side edges.

Here, the upper surfaces 79*a* and 82*a* of the support plates 79 and 82 separated from each other in the sheet width direction D2 protrude upward in the height direction D3 with respect to a plane corresponding to the tangent Z of the lower roller 47. With this positional relationship, both side edges of the sheet bundle S are lifted upward from the plane corresponding to the tangent Z of the lower roller 47, and the curved shape protruding downward is formed.

Further, in comparison with the inside support plates 80 and 81, the upper surfaces 79*a* and 82*a* of the support plates 79 and 82 on both outsides protrude upward in the height direction D3. In other words, with this positional relationship, both side edges of the sheet bundle S are lifted on the downstream side of the lower roller 47, and the curved shape protruding downward is formed. So as to bend the sheet bundle S smoothly, preferably, protrusion amounts of the upper surfaces 79*a* and 82*a* of the support plates 79 and 82 with respect to the inside support plates 80 and 81 are set to be larger toward the downstream side in the sheet discharge direction D1. That is, it is suitable that, in a case viewed in the sheet width direction in a state where the first, second, and third moving members are located in the first position, support portions of the first and second moving members are inclined with respect to a support portion of the third moving member in a manner that protrusion amounts of the support portions of the first and second moving members with respect to the support portion of the third moving member become larger toward the downstream side in the sheet discharge direction.

Further, on the upstream side of the support plates 79 and 82 which are in the protruding position, the lower surface of the sheet bundle S is held by the guide surface 77*g* of the conveyance lower guide 77, so that a posture of the sheet bundle S is determined. On the other hand, on the downstream side of the conveyance lower guide 77, the upper surfaces 79*a* and 82*a* of the support plates 79 and 82 protrude upward from a plane corresponding to the extended line Z' of the guide surface 77*g* in the height direction D3. In other words, with this positional relationship, both side edges of the sheet bundle S are lifted on the downstream side of the conveyance lower guide 77, and the curved shape protruding downward is formed.

As a result, even in a state where a protruding length of a leading edge of the sheet bundle S from the tip portions of the support plates 79 to 82 in the sheet discharge direction D1 becomes larger, hanging down due to the own weight of the sheet bundle S becomes less likely to occur. Further, it is possible to move a position, in which the leading edge of the sheet bundle S starts coming into contact with the sheet already stacked on the lower discharge tray 37, further toward the downstream side in the sheet discharge direction D1. Therefore, it is possible to reduce the degradation of the alignment of the stacked sheet caused by the sliding friction of a newly discharged sheet bundle S with the stacked sheet on the lower discharge tray 37.

It is suitable that the second bending portions on the downstream side in the sheet discharge direction D1 of the support plates 79 and 82 on both outsides are disposed adjacent to the tip portions of the support plates 79 and 82. Thereby, since the support plates 79 and 82 are able to secure wide inclined areas between the first and second bending portions with respect to the tangent Z of the lower roller 47, it becomes possible to form the curved shape of the sheet bundle effectively even in a case where the support plates 79 and 82 that are short in comparison with the length of the sheet bundle are used. Therefore, since the support plates 79 to 82 are not unnecessarily lengthened, it is advantageous in view of a cost reduction and the miniaturization of an apparatus size.

Further, when the support plates 79 and 82 are in the protruding position, the first bending portions of the support plates 79 and 82 on the upstream side in the sheet discharge direction D1 are disposed adjacent to the contact portion 101 (adjacent to the rotational axis of the lower roller 47). Thereby, the swings of the support plates 79 and 82 are started in an earlier timing than when the support plates 79 and 82 move to the storage position from the protruding position, and the tip portions 79*f* and 82*f* start moving downward in the height direction D3. Thereby, the conveyance space of the sheet bundle S is prevented from being narrowed by the tip portions 79*f* and 82*f*, and it is possible to suppress the damage of the sheet bundle S caused by the severe friction of the tip portions 79*f* and 82*f* with the lower surface of the sheet bundle S.

Incidentally, as shown in FIG. 7B, the sheet discharge direction D1 of the discharge roller pair 46 and a stacking surface 37*a* (see FIG. 11A) of the lower discharge tray 37 are both inclined upward toward the left-hand side in FIG. 7B (horizontal direction which is a direction moving away from the side surface of the post-processing apparatus 4). It is suitable that an inclined angle θ1 of the sheet discharge direction D1 with respect to the horizontal direction is larger than an inclined angle θ2 of a contacted portion, which comes into contact with the side surface of the post-processing apparatus 4, on the stacking surface 37*a* of the lower discharge tray 37. Thereby, the sheet in the middle of the discharge by the discharge roller pair 46 becomes less likely to come into contact with the stacked sheet on the lower discharge tray 37. A difference between θ1 and θ2 is to be set at equal to or more than 1°, more preferably, equal to or more than 5°.

It is suitable that inclined angles of the upper surfaces 80*a* and 81*a* of the inside support plates 80 and 81 are set at substantially the same as the inclined angle θ1 of the sheet discharge direction D1 except tolerance and the like. On the other hand, maximum inclined angles θ3 of the outside support plates 79 and 82 (inclined angle of the inclined portion 82*k* in FIG. 7B) are larger than the inclined angle θ1 of the sheet discharge direction D1. So as to form the curved shape of the sheet effectively, a difference between θ3 and θ1 is to be set at, for example, equal to or more than 3°, preferably, equal to or more than 5°, more preferably, equal to or more than 10°. Meanwhile, θ3 is to be set at less than 90°, for example, equal to or less than 80°, preferably, equal to or less than 70° so that the discharge roller pair 46 is able to discharge the sheet to the lower discharge tray 37 stably.

Figure 9:
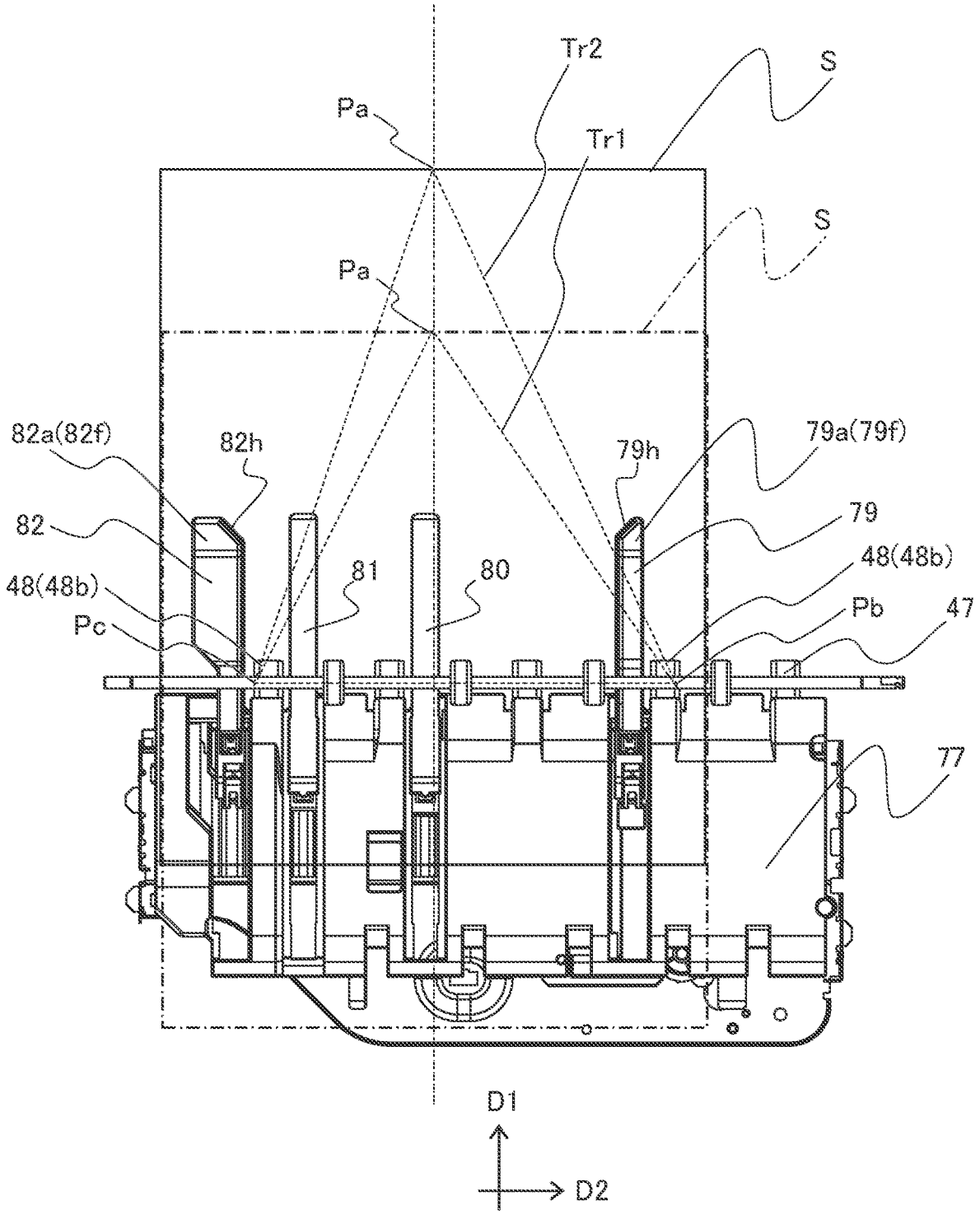
FIG. 9 is a diagram, when viewed from above along a direction perpendicular to an upper surface of the sheet bundle, showing the bundle discharge unit according to the first embodiment and the sheet bundle in the middle of discharge.

The positional relationship of the sheet with the support plates 79 to 82 will be further described. FIG. 9 shows, when viewed from above in the height direction D3, a state of the sheet bundle S which is in the middle of the discharge by the bottom unit 95 and the discharge roller pair 46. So as to form a bent of the sheet bundle S effectively by the support plates 79 and 82 on both outsides, it is preferable that the tip portions 79*f* and 82*f*, protruding most upward in the height direction D3, of the support plates 79 and 82 support the sheet bundle S at positions adjacent to both side edges of the sheet bundle S in the sheet width direction D2. Further, it is preferable that the tip portions 79*f* and 82*f* of the support plates 79 and 82 support the sheet bundle S at positions separated from the discharge roller pair 46 in the sheet discharge direction D1.

Therefore, as shown in FIG. 9, a triangle connecting a central position Pa of the leading edge of the discharged sheet bundle S in the sheet width direction D2 and positions of both side edges Pb and Pc in the sheet width direction D2 of an area in which the discharge roller pair 46 comes into contact with the sheet bundle S is drawn. It is suitable that the tip portions 79*f* and 82*f* of the support plates 79 and 82 support the lower surface of the sheet bundle S in an area outside this triangle in at least part of a period during the discharge of the sheet bundle S. In particular, in a case where the sheet bundle S of the A4 size that is the typical sheet size is discharged in the long edge feed orientation, it is suitable that the tip portions 79*f* and 82*f* of the support plates 79 and 82 are disposed outside a triangle Tr1 drawn at a time when the center (face center) of the sheet bundle S passes through the discharge roller pair 46. It is more preferable that the tip portions 79*f* and 82*f* of the support plates 79 and 82 are positioned outside a triangle Tr2 drawn at a time when the center (face center) of the sheet bundle S passes through the tip portions of the support plates 79 and 82.

To be noted, it is suitable that a similar positional relationship with respect to the triangles Tr1 and Tr2 described above is also established with at least one of (preferably, both of) legal and letter sizes. Further, in this embodiment, the lower surface of the sheet bundle S is supported by four rods of the support plates 79 to 82 at least in a case where the sheet bundle S of the A4 size is discharged in the long edge feed orientation. Here, in a case where, for example, a sheet smaller than the A4 size is discharged, it is acceptable that only the inside support plates 80 and 81 support the lower surface of the sheet bundle S. In such a case, the center position of the small sheet in the sheet width direction D2 is located between the two inside support plates 80 and 81, and both side edges of the small sheet are located inside the two outside support plates 79 and 82. It is possible to change positions and intervals of the four support plates 79 and 82 in the sheet width direction D2 appropriately in accordance with a conceivable sheet size.

Figure 10A:
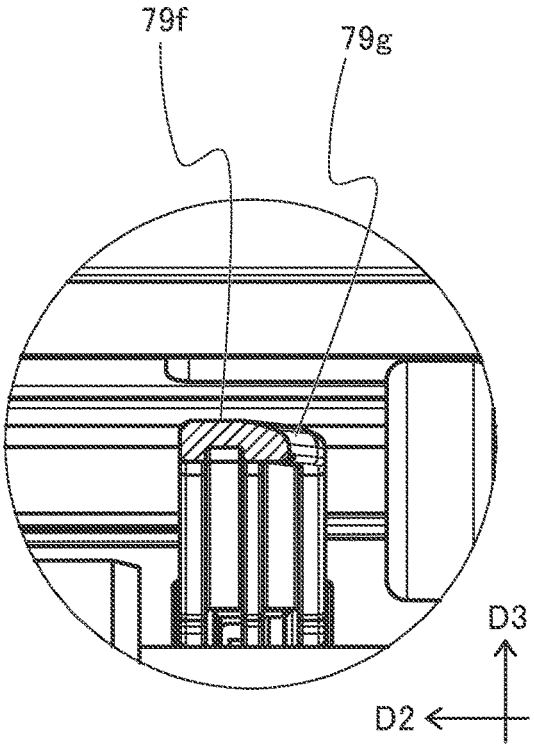
FIGS. 10A and 10B are diagrams each showing a cross-sectional shape of a support plate according to the first embodiment.
Figure 10B:
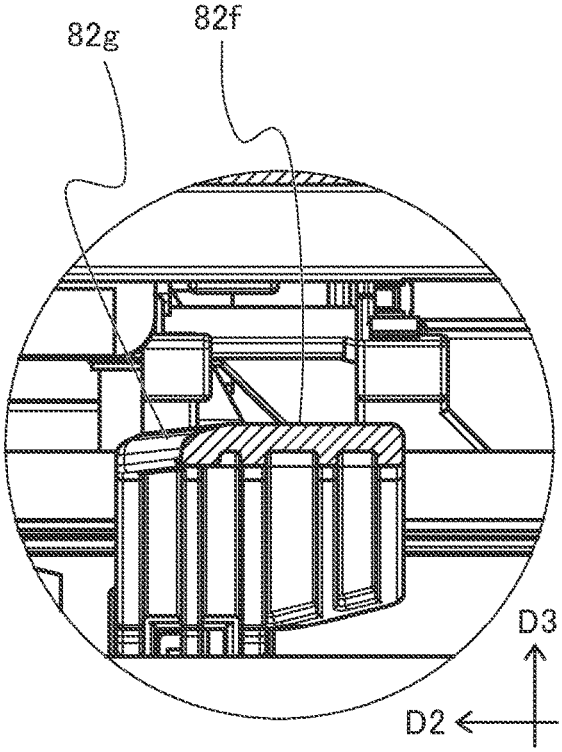

Shapes of the tip portions 79*f* and 82*f* of the support plates 79 and 82 will be described. FIGS. 10A and 10B show cross-sectional views of the tip portions 79*f* and 82*f* of the support plates 79 and 82 cut in an imaginary plane perpendicular to the sheet discharge direction D1. The tip portions 79*f* and 82*f* include tapered portions 79*g* and 82*g* (first tapered portion) inclined downward in the height direction D3 toward the inside in the sheet width direction D2 at the respective inside corners in the sheet width direction D2. It is possible to bring the damage caused by the friction of the lower surface of the sheet bundle S with the corners of the support plates 79 and 82 less likely to occur.

As shown in FIG. 9, in a case viewed in the height direction D3, the tip portions 79*f* and 82*f* of the support plates 79 and 82 include tapered portions 79*h* and 82*h* (second tapered portions) on the downstream side in the sheet discharge direction D1 and at the respective inside corners in the sheet width direction D2. The tapered portions 79*h* and 82*h* are portions inclined to the respective outsides in the sheet width direction D2 toward the downstream side in the sheet discharge direction D1. The tapered portions 79*h* and 82*h* are also possible to bring the damage caused by the friction of the lower surface of the sheet bundle S with the corners of the support plates 79 and 82 less likely to occur.

Movement of Support Plate at a Time of Sheet Discharge

Next, using FIGS. 11A to 11D and FIGS. 12A to 12D, a sheet discharge operation by the bundle discharge unit 36 will be described.

Figure 11A:
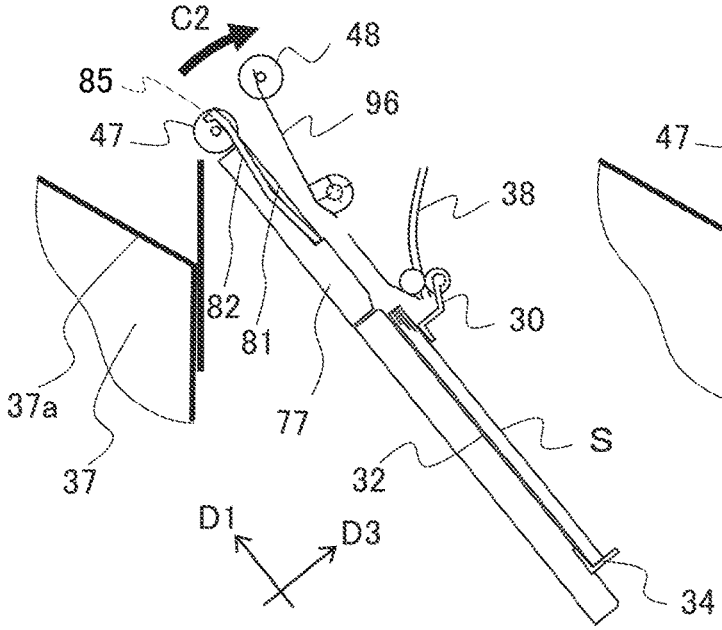
FIGS. 11A to 11D are diagrams each illustrating movements of the bundle discharge unit according to the first embodiment.

As shown in FIG. 11A, when the sheet has been stacked on the intermediate stacking unit 35 and the formation of the sheet bundle S has been started, the motor M2 rotates in the first direction, and a separating operation to move the upper roller 48 in the separating direction C2 by the pressing/separating mechanism described above is performed, so that the discharge roller pair 46 becomes the separated state. The support plate unit 85 including the support plate 79 waits in the storage position. To be noted, in the bundle discharge unit 36, a conveyance upper guide 96 (refer to FIG. 11A), serving as a guide facing the conveyance lower guide 77 in the height direction D3 and guiding the upper surface of the sheet bundle S, is disposed. The conveyance upper guide 96 moves in a manner of moving to and being separated from the conveyance lower guide 77 in conjunction with the movement of the upper roller 48 by the roller support arms 50F and 50R.

Figure 11B:
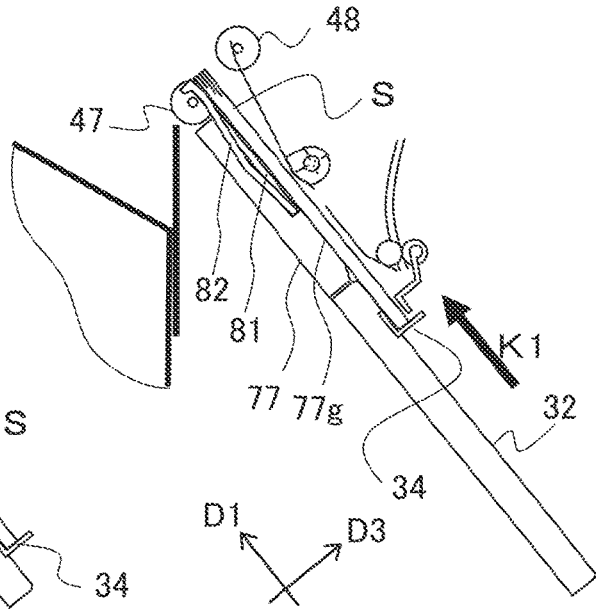

As shown in FIG. 11B, when the sheet bundle S stacked on the intermediate stacking unit 35 has been aligned and process operations such as stapling has ended, the trailing edge of the sheet bundle S is pressed by the bundle discharge guide 34. Thereby, the discharge of the sheet bundle S from the intermediate stacking unit 35 is started toward a K1 direction approximately corresponding to the sheet discharge direction D1 along the stacking lower guide 32.

Figure 11C:
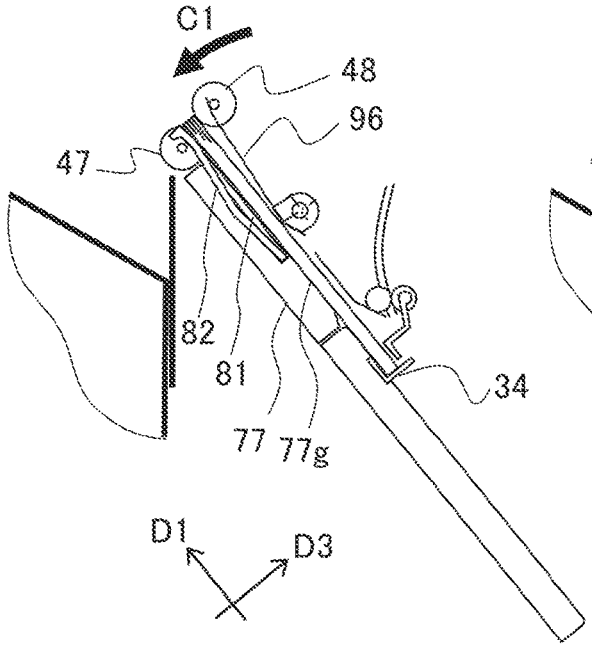

As shown in FIG. 11C, when the leading edge of the sheet bundle S has reached a nip portion of the discharge roller pair 46, the bundle discharge guide 34 stops. Then, the motor M2 rotates in the first direction again, and the nip movement to move the upper roller 48 in the pressing direction C1 is performed, so that the sheet bundle S is nipped by the discharge roller pair 46 which is in the nip state.

Figure 11D:
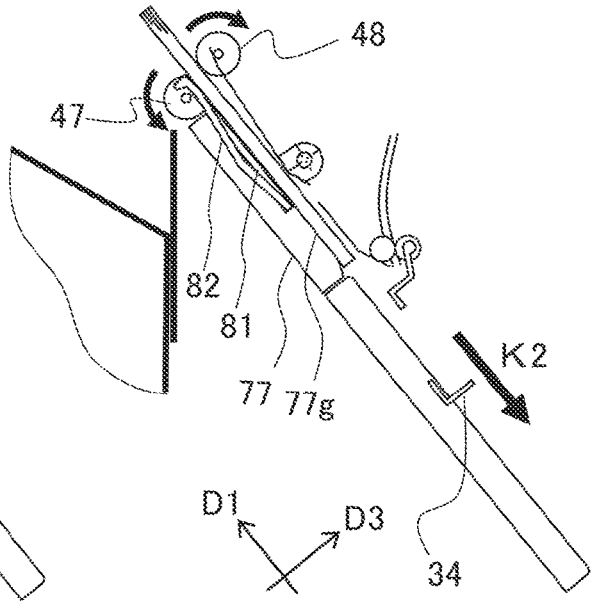

As shown in FIG. 11D, by the rotation of the motor M2 in the second direction, the lower and upper rollers 47 and 48 are rotatably driven, and the discharge of the sheet bundle S by the discharge roller pair 46 is started. At the same time when the discharge roller pair 46 starts the discharge of the sheet bundle S, the bundle discharge guide 34 moves in a K2 direction opposite the sheet discharge direction D1 and stops in a predetermined position so as to prepare for receiving the next sheet. Until this step, the sheet bundle S is in the posture of spreading in an approximately planar shape in the sheet discharge direction D1 and the sheet width direction D2 along the guide surface 77*g* of the conveyance lower guide 77 except a slight bend due to the nip by the discharge roller pair 46.

Figure 12A:
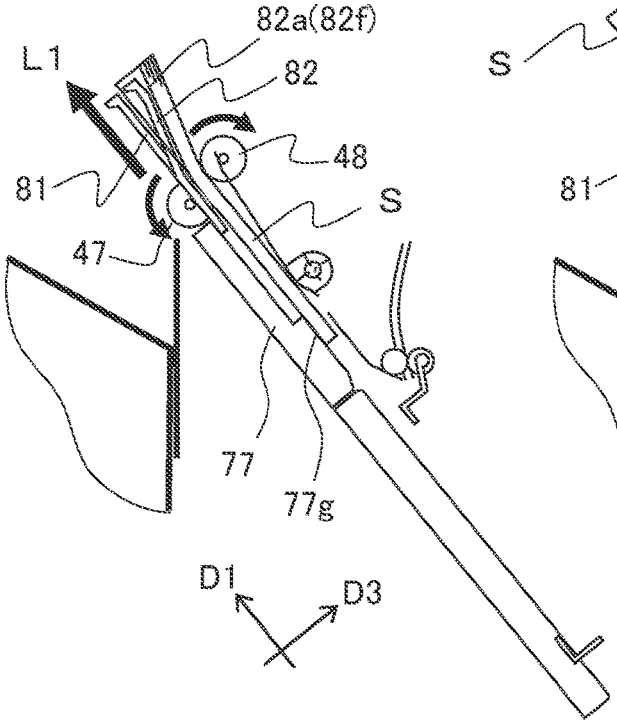
FIGS. 12A to 12D are diagrams each illustrating the movements of the bundle discharge unit according to the first embodiment.

As shown in FIG. 12A, in parallel with the discharge of the sheet bundle S by the discharge roller pair 46, the motor M3 rotates (normal rotation), and the movement (protruding movement, extending movement) of the support plates 79 to 82 in an L1 direction from the storage position toward the protruding position starts. Further, in parallel with the slide movement of the support plates 79 and 82 on both outsides in the sheet discharge direction D1, the tip portions 79*f* and 82*f* swing in a manner of moving upward in the height direction D3. Thereby, the sheet bundle S starts bending such that the central portion in the sheet width direction D2 protrudes downward. As described above, the upper surfaces 79*a* and the 82*a* of the support plates 79 and 82 protrude upward in the height direction D3 with respect to the tangent Z (see FIGS. 7A and 7B) of the lower roller 47, so that both side edges of the sheet bundle S are lifted upward. Further, in other words, since the upper surfaces 79*a* and the 82*a* of the support plates 79 and 82 protrude upward in the height direction D3 in comparison with the inside support plates 80 and 81, both side edges of the sheet bundle S are lifted upward. In other words, since the upper surfaces 79*a* and the 82*a* of the support plates 79 and 82 protrude upward in the height direction D3 on the downstream side of the conveyance lower guide 77, both side edges of the sheet bundle S are lifted upward on the downstream side of the conveyance lower guide 77.

Figure 12B:
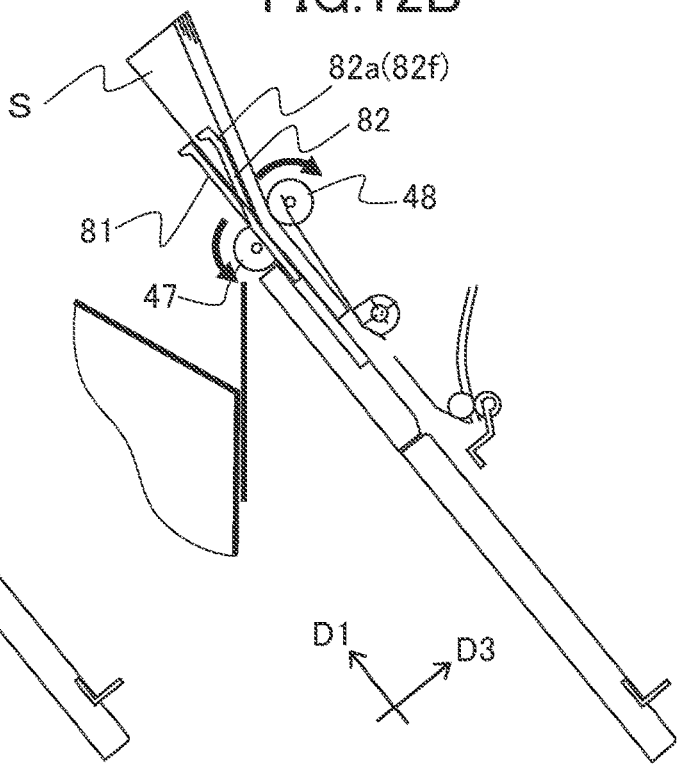

As shown in FIG. 12B, when the support plates 79 to 82 reach the protruding position, the motor M3 stops, and the movements of the support plates 79 to 82 stop. The discharge of the sheet bundle S by the discharge roller pair 46 continues even after the support plates 79 to 82 have stopped. Thereby, while the leading edge of the sheet bundle S goes over the support plates 79 to 82 and protrudes downstream in the sheet discharge direction D1, hanging down of the leading edge of the sheet bundle S is suppressed by the curved shape formed by the support plates 79 to 82.

Figure 12C:
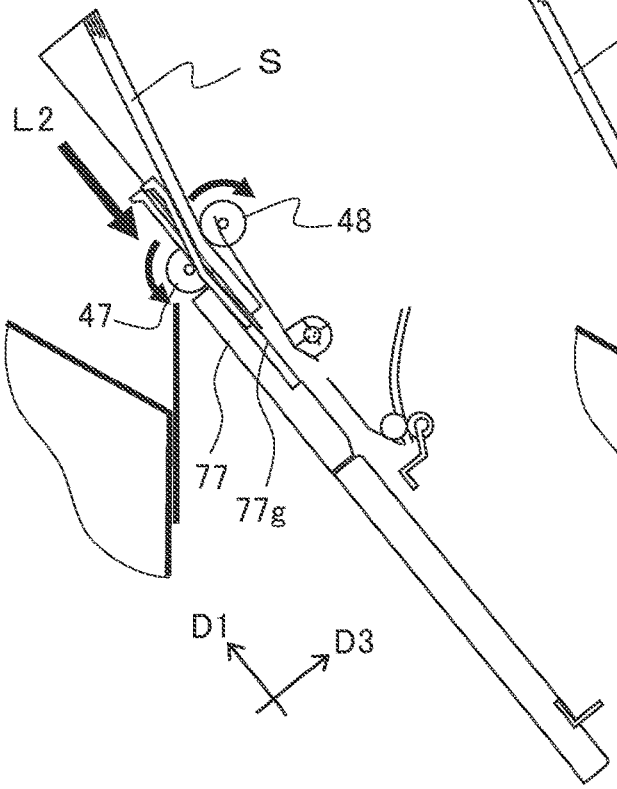

As shown in FIG. 12C, when the trailing edge of the sheet bundle S approaches the discharge roller pair 46, the motor M3 rotates in reverse, and the movements (storage movement) of the support plates 79 to 82 in an L2 direction from the protruding position toward the storage position starts. A start timing and a moving speed of the storage movements of the support plates 79 to 82 are set such that a timing in which the trailing edge of the sheet bundle S passes through the discharge roller pair 46 is approximately the same as a timing in which the support plates 79 to 82 reach the storage position.

Figure 12D:
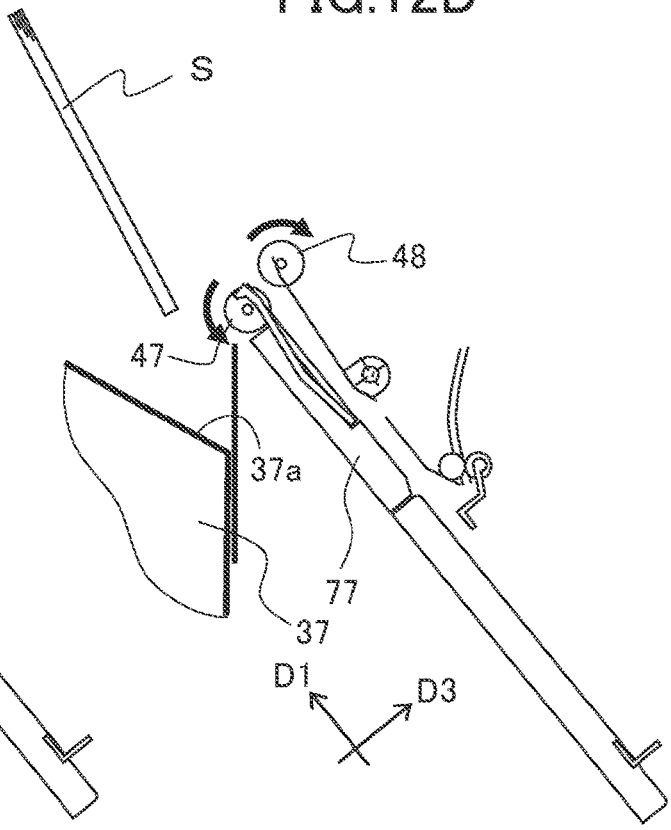

As shown in FIG. 12D, when the trailing edge of the sheet bundle S passes through the discharge roller pair 46, the sheet bundle S lost the support of the support plates 79 to 82 falls by own weight, and stacked on the lower discharge tray 37.

As described above, in this embodiment, the sheet is discharged while forming the curved shape on the sheet by the support plates 79 to 82 supporting the lower surface of the sheet. Thereby, it is possible to reduce the degradation of the alignment of the stacked sheet occurred in a case where the leading edge of the sheet in the middle of the discharge hangs down by the own weight and slidingly rubs the stacked sheet on the lower discharge tray 37.

Second Embodiment

Figure 13:
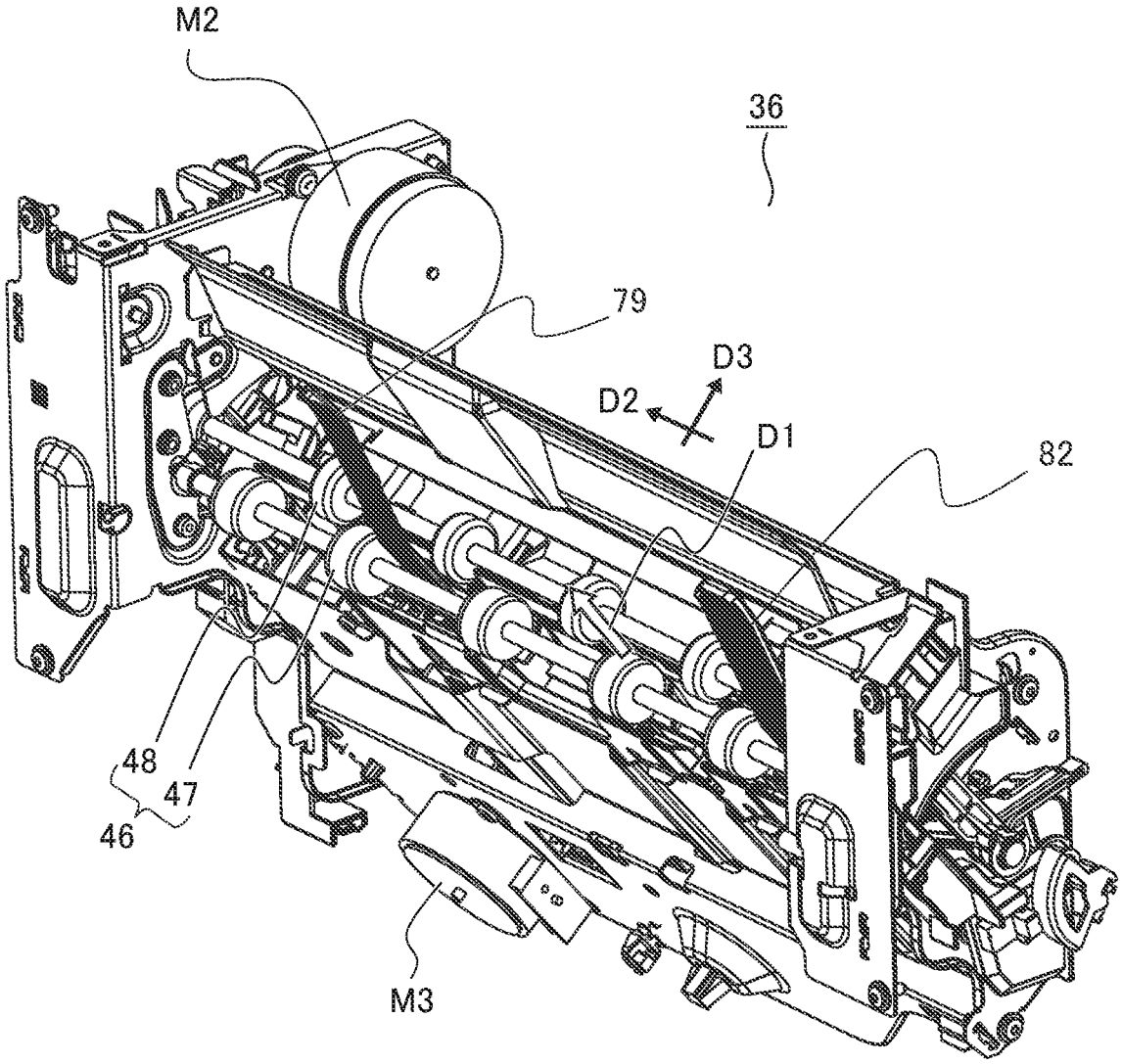
FIG. 13 is a perspective view showing a bundle discharge unit according to a second embodiment.

FIG. 13 shows a perspective view of a bundle discharge unit 36 according to a second embodiment. In this embodiment, the inside support plates 80 and 81 of the bundle discharge unit 36 in the first embodiment are omitted, and only the support plates 79 and 82 on both outsides are included. Since, while this embodiment is different from the first embodiment as described above, configurations of the post-processing apparatus 4 except the above are the same as the first embodiment, descriptions of configurations similar to the first embodiment will be omitted herein.

As described in the first embodiment, when the support plates 79 and 82 are in the protruding position, the tip portions 79*f* and 82*f* and the inclined portions 79*k* and 82*k* protrude upward in the height direction D3 from the extended line Z' of the guide surface 77*g* of the conveyance lower guide 77 (refer to FIG. 7B). That is, at least parts of the support plates 79 and 82 in the protruding position protrude upward in the height direction D3 with respect to the extended line Z' of the guide surface 77*g* of the conveyance lower guide 77. Further, similar to the first embodiment, at least the parts of the support plates 79 and 82 in the protruding position protrude upward in the height direction D3 with respect to the tangent Z of the lower roller 47.

With this configuration, both side edges in the sheet width direction D2 of the sheet guided by the conveyance lower guide 77 and discharged in the sheet discharge direction D1 are lifted by support plates 79 and 82 on the downstream side of the discharge roller pair 46 or the downstream side of the conveyance lower guide 77. Then, in a case viewed from the downstream side in the sheet discharge direction D1, the curved shape in which the central portion of the sheet in the sheet width direction D2 protrudes downward from both side edges is formed. Thereby, it is possible to suppress hanging down of the leading edge of the sheet. That is, with the configuration of this embodiment in which the inside support plates 80 and 81 are omitted, similar to the first embodiment, it is possible to suppress the degradation of the alignment of the stacked sheet occurred in a case where the newly discharged sheet slidingly rubs the stacked sheet on the lower discharge tray 37.

Third Embodiment

Using FIG. 14A to 14C and FIG. 15, configurations according to a third embodiment will be described. In this embodiment, a mechanism which moves the support plates 79 and 82 in conjunction with the slide movements of the support plates 79 and 82 is different from the first embodiment. Since configurations of the post-processing apparatus 4 except the above are similar to the first embodiment, descriptions of configurations similar to the first embodiment will be omitted herein.

Figure 14A:
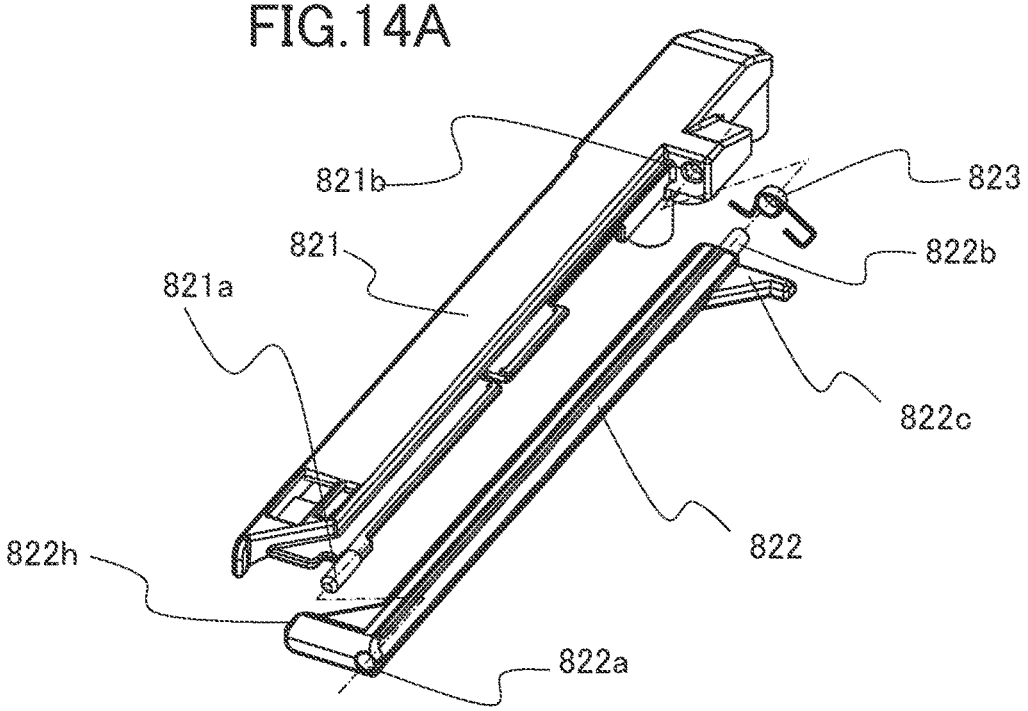
FIG. 14A is an exploded view showing a support plate according to a third embodiment.
Figure 14B:
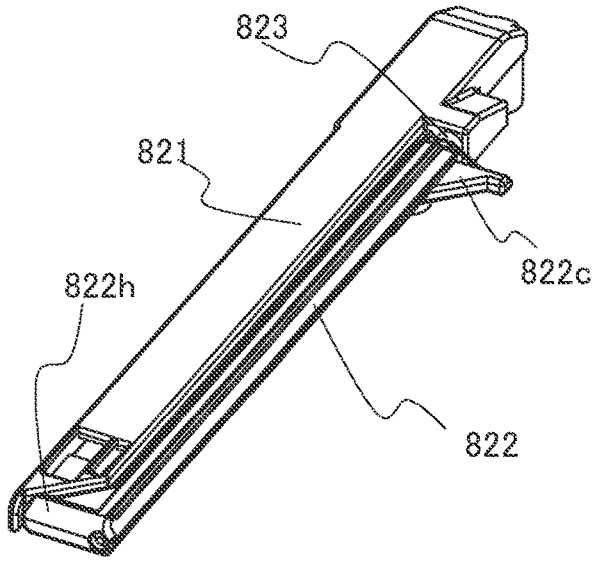
FIGS. 14B and 14C are perspective views of the support plate according to the third embodiment.
Figure 14C:
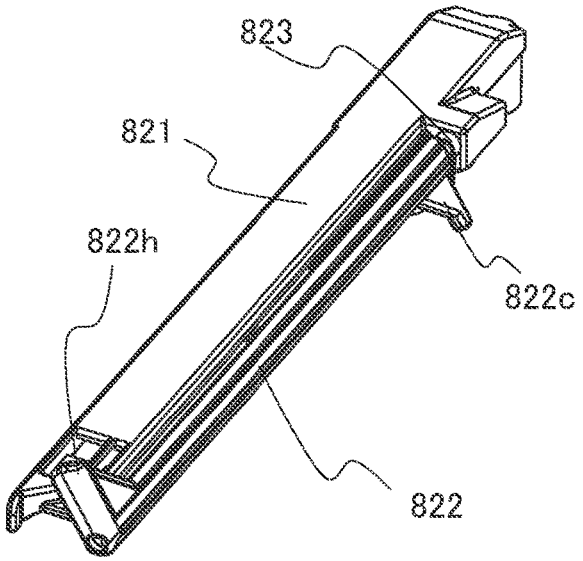
Figure 15:
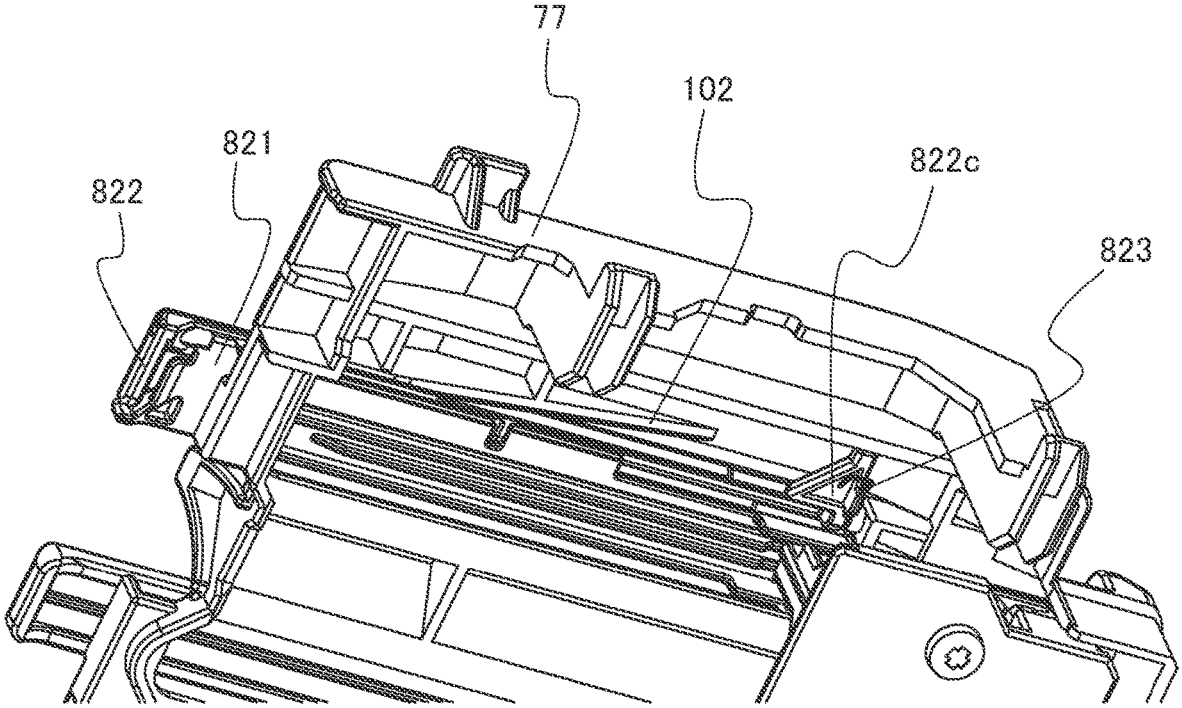
FIG. 15 is a perspective view showing a part of a bottom unit according to the third embodiment.

FIG. 14A is an exploded view of the support plate 82 according to this embodiment. FIGS. 14B and 14C are perspective views of the support plate 82 according to this embodiment. FIG. 15 is a perspective view, when viewed from below in the height direction D3, showing the bottom unit 95 according to this embodiment.

As shown in FIG. 14A, the support plate 82 includes a base 821, a pivot portion 822, and a return spring 823. The base 821 is fastened to the support plate holder 78 by a screw, not shown, facing the support plate holder 78 across the conveyance lower guide 77.

A shaft 821*a* and a hole 821*b* are disposed in the base 821. The pivot portion 822 includes a hole 822*a* engaging with the shaft 821*a* and a shaft 822*b* engaging with the hole 821*b*. The shafts 821*a* and 822*b* are disposed on a common axis extending in the sheet discharge direction D1. Further, the pivot portion 822, serving as a protruding portion protruding in a direction intersecting with the sheet discharge direction D1, includes a driven portion 822*c* and a sheet support portion 822*h*.

The pivot portion 822 is pivotably supported with respect to the base 821 around the shafts 821*a* and 822*b* as the center in a rotational direction inside a plane perpendicular to the sheet discharge direction D1. The pivot portion 822 moves to a lower position where the height of the sheet support portion 822*h* becomes equal to or lower than the height of the base 821 as shown in FIG. 11B, and to an upper position where the sheet support portion 822*h* protrudes upward in the height direction D3 from the base 821 as shown in FIG. 11C. The return spring 823 urges the pivot portion 822 toward the lower position.

As shown in FIG. 15, a rib 102 extending in the sheet discharge direction D1 is disposed on the conveyance lower guide 77. The rib 102 is formed so as to change height along the sheet discharge direction D1, so that, during a time when the support plate 82 moves to the protruding position from the storage position, the rib 102 comes into contact with the driven portion 822*c* of the pivot portion 822 and pivots the pivot portion 822 from the lower position to the upper position. In a state where the support plate 82 is located in the protruding position, the sheet support portion 822*h* protrudes upward in the height direction D3 with respect to the tangent Z (refer to FIG. 7B) of the lower roller 47. When the support plate 82 moves to the storage position from the protruding position, the pivot portion 822 pivots to the lower position by an urging force of the return spring 823, the sheet support portion 822*h* retracts below the tangent Z. To be noted, while the support plate 82 of the front side is described here, the support plate 79 on the rear side is constructed similarly.

With this configuration, when the support plates 79 and 82 are in the protruding position, the sheet support portions 822*h* of the support plates 79 and 82 protrude upward in the height direction D3 with respect to the tangent Z (refer to FIG. 7B) of the lower roller 47. That is, also in this embodiment, at least the parts of the support plates 79 and 82 that are in the protruding position protrude upward in the height direction D3 with respect to the tangent Z, which comes into contact with the outer peripheral surface of the roller body 47*b* of the lower roller 47 and extends parallel to the guide surface 77*g* of the conveyance lower guide 77. Further, the support plates 79 and 82 that are in the protruding position protrude upward in the height direction D3 from the inside support plates 80 and 81. Therefore, with the configuration of this embodiment, it is also possible to produce a result similar to the first embodiment.

Other Examples

While, in the embodiments described above, a configuration in which the discharge roller pair 46 is used as the discharger to discharge the sheet (including the sheet bundle) is described, it is acceptable to use, for example, the bundle discharge guide 34 (see FIG. 1) as the discharger. In such a case, the bundle discharge guide 34 is configured such that the bundle discharge guide 34 is capable of moving to a position adjacent to the opening portion where the second discharge path P4 opens to the outside of the post-processing apparatus 4.

Further, while, in the embodiments described above, the post-processing apparatus 4 which is connected to the image forming apparatus 1 is described, the present technology is applicable to apparatuses handling the sheet other than the image forming system. For instance, it is acceptable to apply the present technology to a sorting apparatus for sorting a booklet and book. To be noted, the "image forming system" is not limited to an apparatus in which the image forming apparatus and the post-processing apparatus 4 independent from each other are connected, but includes an apparatus in which the image forming unit and the post-processing unit are housed in a single casing.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-026311, filed on Feb. 22, 2021, which is hereby incorporated by reference herein in its entirety.

What is claimed is:

1. A sheet discharging apparatus comprising:

a guide member configured to guide a lower surface of a sheet that is discharged;

a discharge roller pair including an upper roller configured to be in contact with an upper surface of the sheet and a lower roller configured to be in contact with the lower surface of the sheet, the discharge roller pair being configured to discharge the sheet in a sheet discharge direction by nipping the sheet with the upper roller and the lower roller;

a stacking portion on which the sheet discharged by the discharge roller pair is stacked; and a first moving member and a second moving member each configured to move to a first position and a second position, the first position being a position where the first moving member and the second moving member protrude downstream of the discharge roller pair in the sheet discharge direction, the second position being a position located upstream of the first position in the sheet discharge direction, the first moving member and the second moving member being disposed separately from each other in a sheet width direction perpendicular to the sheet discharge direction, wherein each of the first moving member and the second moving member includes a support portion configured to support the lower surface of the sheet sent from the discharge roller pair, and wherein the support portions of the first moving member and the second moving member in the first position protrude upward in a height direction with respect to a tangent of the lower roller as viewed in the sheet width direction, the height direction being a direction orthogonally intersecting with both of the sheet discharge direction and the sheet width direction, the tangent of the lower roller being a straight line that is parallel to the guide member, is tangent to an outer peripheral surface of the lower roller, and passes above a rotational axis of the lower roller.

2. The sheet discharging apparatus according to claim 1, further comprising:

a third moving member configured to move to the first position and the second position and disposed between the first moving member and the second moving member in the sheet width direction, the third moving member including a support portion configured to support the lower surface of the sheet sent from the discharge roller pair, wherein, in a state where the first moving member, the second moving member, and the third moving member are located in the first position, both the support portions of the first moving member and the second moving member protrude upward in the height direction with respect to the support portion of the third moving member.

3. The sheet discharging apparatus according to claim 2, wherein, on a downstream side of the discharge roller pair in the sheet discharge direction, the support portion of the third moving member is located below the tangent of the lower roller in the height direction.

4. The sheet discharging apparatus according to claim 2, wherein, as viewed in the sheet width direction in a state where the first moving member, the second moving member, and the third moving member are located in the first position, both the support portions of the first moving member and the second moving member are inclined with respect to the support portion of the third moving member in a manner such that protrusion amounts of both of the support portions of the first moving member and the second moving member from the support portion of the third moving member increase toward a downstream side in the sheet discharge direction.

5. The sheet discharging apparatus according to claim 1, wherein:

the upper roller of the discharge roller pair is configured to move to and away from the lower roller, the discharge roller pair is configured to discharge a sheet bundle that is constituted by a plurality of sheets and is processed in a processing unit disposed upstream of the guide member in the sheet discharge direction.

6. The sheet discharging apparatus according to claim 1, wherein:

tip portions of the support portions of the first moving member and the second moving member in the sheet discharge direction protrude most upward in the support portions in the height direction in a state where the first moving member and the second moving member are located in the first position, and in a state where a letter size sheet is discharged in a long edge feed orientation, as the first moving member and the second moving member are viewed in the height direction at a time when a central position of the letter size sheet in the sheet discharge direction passes through the discharge roller pair, the tip portions of the support portions of the first moving member and the second moving member are located outside a triangle connecting a central position of a leading edge of the letter size sheet in the sheet discharge direction and positions of both side edges in the sheet width direction of an area in which the discharge roller pair comes into contact with the letter size sheet, the central position of the leading edge of the letter size sheet in the sheet discharge direction being a central position in terms of the sheet width direction.

7. The sheet discharging apparatus according to claim 1, wherein the first moving member and the second moving member are disposed on one side and on another side with respect to a central position of a letter size sheet in the sheet width direction in a state where the letter size sheet is discharged in a long edge feed orientation.

8. The sheet discharging apparatus according to claim 1, wherein each of the support portions of the first moving member and the second moving member includes a tapered portion inclined downward in the height direction toward an inside in the sheet width direction, the tapered portions being provided at corner parts, on the inside in the sheet width direction and on an upper side in the height direction, of the support portions of the first moving member and the second moving member.

9. The sheet discharging apparatus according to claim 1, wherein, each of the first moving member and the second moving member includes a tapered portion inclined to an outside in the sheet width direction toward a downstream side in the sheet discharge direction, the tapered portions being provided at corner parts, on an inside in the sheet width direction and on the downstream side in the sheet discharge direction, of the support portions of the first moving member and the second moving member.

10. The sheet discharging apparatus according to claim 1, wherein, each of the support portions of the first moving member and the second moving member includes an inclined portion configured to be inclined upward in the height direction toward a downstream side in the sheet discharge direction as viewed in the sheet width direction in a state where the first moving member and the second moving member are located in the first position.

11. The sheet discharging apparatus according to claim 10, wherein:

each of the support portions of the first moving member and the second moving member includes an upstream portion provided upstream of the inclined portion in the sheet discharge direction and a downstream portion provided downstream of the inclined portion in the sheet discharge direction, the upstream portion and the downstream portion both extending at angles closer to the sheet discharge direction than an angle of the inclined portion as viewed in the sheet width direction in the state where the first moving member and the second moving member are located in the first position, and for each of the support portions of the first moving member and the second moving member, a distance between a first bending portion and a second bending portion in the sheet discharge direction is equal to or more than a half of protrusion lengths of the first moving member and the second moving member in the sheet discharge direction, the first bending portion being disposed between the upstream portion and the inclined portion, the second bending portion being disposed between the inclined portion and the downstream portion.

12. The sheet discharging apparatus according to claim 1, further comprising:

a holder configured to movably hold the first moving member and the second moving member and to slide in the sheet discharge direction, wherein the first moving member and the second moving member are configured such that the support portions of the first moving member and the second moving member move upward in the height direction in conjunction with a slide movement of the holder.

13. The sheet discharging apparatus according to claim 12, wherein:

an upstream end of each of the first moving member and the second moving member in the sheet discharge direction is configured to be supported swingably around an axis extending in the sheet width direction, and the sheet discharging apparatus further comprises a contact portion fixed to a frame body of the sheet discharging apparatus, the contact portion being configured to come into contact with lower surfaces of the first moving member and the second moving member in the height direction so as to lift the first moving member and the second moving member in conjunction with a movement of the holder to a downstream side in the sheet discharge direction.

14. The sheet discharging apparatus according to claim 12, wherein:

each of the first moving member and the second moving member is configured to be supported swingably around an axis extending in the sheet discharge direction, and the sheet discharging apparatus further comprises a contact portion fixed to a frame body of the sheet discharging apparatus, the contact portion being configured to come into contact with the first moving member and the second moving member in conjunction with a movement of the holder to a downstream side in the sheet discharge direction so as to rotate the first moving member and the second moving member and move the support portions of the first moving member and the second moving member upward in the height direction.

15. A sheet processing apparatus comprising:

a processing unit configured to process a sheet; and the sheet discharging apparatus according to claim 1, which is configured to discharge the sheet processed by the processing unit.

16. The sheet processing apparatus according to claim 15, wherein:

the processing unit includes an intermediate stacking portion on which a plurality of sheets are stacked and a binding unit configured to bind the plurality of sheets stacked on the intermediate stacking portion, and the sheet discharging apparatus discharges a sheet bundle bound by the binding unit.

17. An image forming system comprising:

an image forming unit to form an image on a sheet; and the sheet processing apparatus according to claim 15, which is configured to process the sheet on which the image is formed by the image forming unit.

* * * * *